US008632348B2

(12) United States Patent
Baldwin et al.

(10) Patent No.: US 8,632,348 B2
(45) Date of Patent: Jan. 21, 2014

(54) ELECTRICAL CORD WITH TAMPER RESISTANT MECHANISM

(71) Applicant: Hubbell Incorporated, Shelton, CT (US)

(72) Inventors: Jeffrey P. Baldwin, Phoenix, AZ (US); Marcus J. Shotey, Scottsdale, AZ (US); Richard L. Cleghorn, Tempe, AZ (US); Ryan K. Liebengood, Mesa, AZ (US); Jason Thomas, Mesa, AZ (US); Kenneth C. Booth, Mesa, AZ (US); John Klein, Gilbert, AZ (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 13/912,348

(22) Filed: Jun. 7, 2013

(65) Prior Publication Data

US 2013/0295788 A1 Nov. 7, 2013

Related U.S. Application Data

(63) Continuation of application No. 13/482,101, filed on May 29, 2012, now Pat. No. 8,491,319, which is a continuation of application No. 13/274,934, filed on Oct. 17, 2011, now Pat. No. 8,187,012, which is a continuation-in-part of application No. 13/050,777, filed on Mar. 17, 2011, now Pat. No. 8,187,011.

(60) Provisional application No. 61/315,368, filed on Mar. 18, 2010, provisional application No. 61/389,612, filed on Oct. 4, 2010.

(51) Int. Cl.
*H01R 13/44* (2006.01)

(52) U.S. Cl.
USPC ..... 439/138

(58) Field of Classification Search
USPC ..... 439/135–141, 145, 911
See application file for complete search history.

(56) References Cited

U.S. PATENT DOCUMENTS

| | | | | |
|---|---|---|---|---|
| 3,990,758 | A | | 11/1976 | Petterson |
| 4,780,591 | A | * | 10/1988 | Bernecki et al. ..... 219/121.52 |
| 5,020,997 | A | | 6/1991 | Calderara |
| 5,095,182 | A | | 3/1992 | Thompson |
| 5,244,398 | A | | 9/1993 | Chou |
| 5,267,870 | A | | 12/1993 | Maresh |
| 5,277,602 | A | | 1/1994 | Yi |
| 5,281,156 | A | | 1/1994 | Yi |

(Continued)

*Primary Examiner* — Neil Abrams
*Assistant Examiner* — Phuongchi T Nguyen
(74) *Attorney, Agent, or Firm* — Marcus R. Mickney; Mark S. Bicks; Alfred N. Goodman

(57) ABSTRACT

An electrical cord including a plug on a first end and at least one socket on a second end opposite the first end, a protective shutter assembly disposed within the at least one socket, the shutter assembly including a first and second shutter members positioned proximate the cover assembly and each of the first and second shutter members is at least partially aligned with separate cover openings in the cover assembly and being configured to move from a closed position to an open position in response to engaging at least one plug blade, a third shutter member positioned behind the first shutter member, a fourth shutter member positioned behind the second shutter member, and wherein the first and second shutter members pivot from the closed position to the open position and the third and fourth shutter members slide from the closed position to the open position.

23 Claims, 44 Drawing Sheets

(56) References Cited

U.S. PATENT DOCUMENTS

| | | | |
|---|---|---|---|
| 5,320,545 | A | 6/1994 | Brothers |
| 5,915,981 | A | 6/1999 | Mehta |
| 5,998,735 | A | 12/1999 | Patterson, Jr. |
| 6,054,564 | A | 4/2000 | Barany |
| 6,056,564 | A | 5/2000 | Huang |
| 6,086,391 | A | 7/2000 | Chiu |
| 6,111,210 | A | 8/2000 | Allison |
| 6,217,353 | B1 | 4/2001 | Yu-Tse |
| 6,229,107 | B1 | 5/2001 | Flint |
| 6,238,224 | B1 | 5/2001 | Shao |
| 6,422,880 | B1 | 7/2002 | Chiu |
| 6,537,088 | B2 | 3/2003 | Huang |
| 6,555,771 | B2 | 4/2003 | Shao |
| 6,776,630 | B1 | 8/2004 | Huang |
| 6,786,745 | B1 | 9/2004 | Huang |
| 6,893,275 | B2 | 5/2005 | Ng |
| 6,932,631 | B2 | 8/2005 | Huang |
| 7,114,968 | B2 | 10/2006 | Healy |
| 7,179,992 | B1 | 2/2007 | Packard |
| 7,214,101 | B1 | 5/2007 | Tong |
| 7,312,394 | B1 | 12/2007 | Weeks |
| 7,312,963 | B1 | 12/2007 | Radosavljevic |
| 7,355,117 | B2 | 4/2008 | Castaldo |
| 7,438,567 | B2 | 10/2008 | Nalwad |
| 7,452,221 | B1 | 11/2008 | Oddsen |
| 7,455,538 | B2 | 11/2008 | Germain |
| 7,510,412 | B1 | 3/2009 | Valentin |
| 7,527,508 | B1 | 5/2009 | Lee |
| 7,551,047 | B2 | 6/2009 | Sokolow |
| 7,556,513 | B2 | 7/2009 | Ng |
| 7,588,447 | B1 | 9/2009 | Ni |
| 7,595,449 | B1 | 9/2009 | Dyderski |
| 7,637,756 | B1 | 12/2009 | Hsu |
| 7,642,457 | B2 | 1/2010 | Weeks |
| 7,645,148 | B2 | 1/2010 | Carbone |
| 7,645,149 | B2 | 1/2010 | Carbone |
| 7,651,347 | B2 | 1/2010 | Germain |
| 7,883,346 | B2 | 2/2011 | Huang |
| 2008/0156512 | A1 | 7/2008 | Castaldo |
| 2008/0248662 | A1 | 10/2008 | Bazayev |
| 2009/0023304 | A1 | 1/2009 | Gerard |
| 2009/0236115 | A1 | 9/2009 | Li |
| 2009/0286411 | A1 | 11/2009 | Bazayev |
| 2009/0311892 | A1 | 12/2009 | Weeks |
| 2010/0041259 | A1 | 2/2010 | Ni |
| 2010/0130053 | A1* | 5/2010 | Ziobro ..... 439/404 |
| 2011/0136358 | A1 | 6/2011 | Zhang |

* cited by examiner

ELECTRICAL CORD WITH TAMPER RESISTANT MECHANISM

CROSS REFERENCE TO RELATED APPLICATIONS

This application is a continuation of U.S. patent application Ser. No. 13/482,101 to Baldwin et al. entitled "Electrical Cord With Tamper Resistent Mechanism" which was filed on May 29, 2012, which is a continuation of U.S. patent application Ser. No. 13/274,934 to Baldwin et al. entitled "Electrical Cord with Tamper Resistent Mechanism", which was filed on Oct. 17, 2011, which application was a continuation-in-part of U.S. patent application Ser. No. 13/050,777 to Baldwin et al. entitled "Tamper Resistant Electrical Device", which was filed on Mar. 17, 2011, which application claimed the benefit of U.S. Provisional Patent Application 61/315,368 to Baldwin et al. entitled "Tamper Resistant Receptacles", which was filed on Mar. 18, 2010, and U.S. Provisional Patent Application 61/389,612 to Cleghorn et al. entitled "Tamper Resistant Shutters for an Electrical Device" which was filed on Oct. 4, 2010, the entire disclosures of which are hereby incorporated herein by reference.

BACKGROUND OF THE INVENTION

1. Technical Field

Aspects of the present disclosure relate to electrical receptacles and electrical cords that selectively prevent and permit objects to engage electrical contacts within the receptacle and electrical cord to reduce the risk of electrocution.

2. Background Art

Electrical devices, and specifically electrical receptacles capable of receiving electrical plugs to provide electricity to the electrical plug are well known. In the United States, electrical receptacles generally include two or three prongs, with each set arranged to receive an electrical plug. Electrical receptacles, with the exception of Ground Fault Circuit Interrupters (GFCI) are generally always active, meaning they provide electricity to the electrical receptacle contacts at all times. GFCI devices function similarly, except they can restrict electrical current in the event that a short or current imbalance is detected in the circuit. After a fault is detected, the GFCI cuts off power to the electrical receptacle contacts until a user resets the GFCI.

Nevertheless, children in particular are susceptible to being shocked in the event that the child inserts a conductive object into an electrical receptacle opening. Conductive objects may include knives, paper clips, screw drivers, or the like that a child inserts into the opening and receives an electrical shock, electrocution, or a burn. One attempt to alleviate the potential for electrocution has been to incorporate doors in the electrical device that must be overcome before the object can reach the electrical contacts. Each of these attempts includes complex mechanisms which are unnecessary or difficult to manufacture. Other attempts may be less complex, but are very cumbersome to operate or are inefficient. Finally, some tamper resistant electrical devices wear out quickly and no longer protect the consumer, and particularly children, from electrical shock hazards.

Electrical cords have long been a danger when plugged into an active outlet. Once the electrical cord is connected to an active receptacle, a child may be injured by inserting a conductive object into the opposite end of the electrical cord that is free.

SUMMARY

This disclosure includes one or more electrical devices and electrical cords with tamper resistant members which prevent access to the electrical terminals by unauthorized articles.

A particular aspect broadly includes an electrical cord including a plug on a first end and at least one socket on a second end opposite the first end, a protective shutter assembly disposed within the at least one socket, the shutter assembly including a first shutter member and a second shutter member each positioned proximate the cover assembly and each of the first and second shutter members is at least partially aligned with separate cover openings in the cover assembly and being configured to move from a closed position to an open position in response to engaging a plug blade, a third shutter member positioned behind the first shutter member, a fourth shutter member positioned behind the second shutter member, and wherein the first, second, third, and fourth shutter members are each separate components.

In particular implementations, the first shutter member may be pivotally connected to the fourth shutter member and the second shutter member may be pivotally connected to the third shutter member. The first and second shutter members may be pivotally moved from the closed position to the open position in response to engagement by the plug blade. The third and fourth shutter members may be linearly moved from the closed position to the open position in response to engagement by the plug blade. The first and second shutter members may pivot in the same direction from the closed position to the open position. The first and second shutter members may pivot in opposite directions from the closed position to the open position.

In additional particular implementations, the first shutter member may pivot from the closed position to the open position in response to engaging the plug blade and the fourth shutter member may be linearly moved from the closed position to the open position by the pivotal movement of the first shutter member. The second shutter member may pivot from the closed position to the open position in response to engaging the plug blade and the third shutter member may be linearly moved from the closed position to the open position by the pivotal movement of the second shutter member. The third and fourth shutter members may be biased into the closed position with a spring.

The first, second, third, and fourth shutter members may each further include an engagement portion with a radius. The first shutter member engagement portion may contact the fourth shutter member engagement portion during operation and the second shutter member engagement portion may contact the third shutter member engagement portion during operation. The shutter assembly may also include a first stop limiting linear movement of the third shutter member in a closing direction and a second stop limiting linear movement of the fourth shutter member in a closing direction. The first and second shutter members may pivot in the direction of the plug blade insertion.

The electrical cord may be an extension cord. The at least one socket may be a plurality of non-movable sockets forming a power strip. The power strip may be surge protected. The at least one socket is a plurality of flexible sockets having independent mobility from one another. The at least one socket is selected from the group consisting of three sockets, four sockets, five sockets, six sockets, seven sockets, and eight sockets.

A particular aspect may broadly include an electrical cord including a plug on a first end and a plurality of sockets with a cover having a plurality of openings on a second end opposite the first end, a protective shutter assembly disposed within each of the plurality of sockets, each of the shutter assemblies including a first shutter member and second shutter member positioned proximate the cover and each of the first and second shutter members is at least partially aligned with separate cover openings in the cover and configured to move from a closed position to an open position in response to engaging at least one plug blade, a third shutter member positioned behind the first shutter member, a fourth shutter member positioned behind the second shutter member, and wherein the first and second shutter members pivot from the closed position to the open position and the third and fourth shutter members slide from the closed position to the closed position to the open position.

In particular implementations, the fourth shutter member is slid from the closed position to the open position by the first shutter member pivoting from the closed position to the open position and the third shutter member is slid from the closed position to the open position by the second shutter member pivoting from the closed position to the open position. The first and second shutter members pivot in opposite directions and the third and fourth shutter members slide in opposite directions. The electrical cord may be a power strip and the pluralities of sockets are rigidly mounted on the second end. The electrical cord is a power strip and the plurality of sockets are flexibly mounted on the second end.

A particular aspect may broadly comprise an electrical cord including a plug on a first end and at least one socket on a second end opposite the first end, a protective shutter assembly disposed within the at least one socket and adjacent electrical contacts within the at least one socket, and wherein the protective shutter assembly permits an electrical plug to contact the electrical contacts and prevents a non-electrical plug from contacting the electrical contacts.

BRIEF DESCRIPTION OF THE DRAWINGS

Features of particular embodiments and implementations of tamper resistant electrical devices will hereinafter be described in conjunction with the appended drawings, where like designations denote like elements, and.

DETAILED DESCRIPTION

Figure 1:
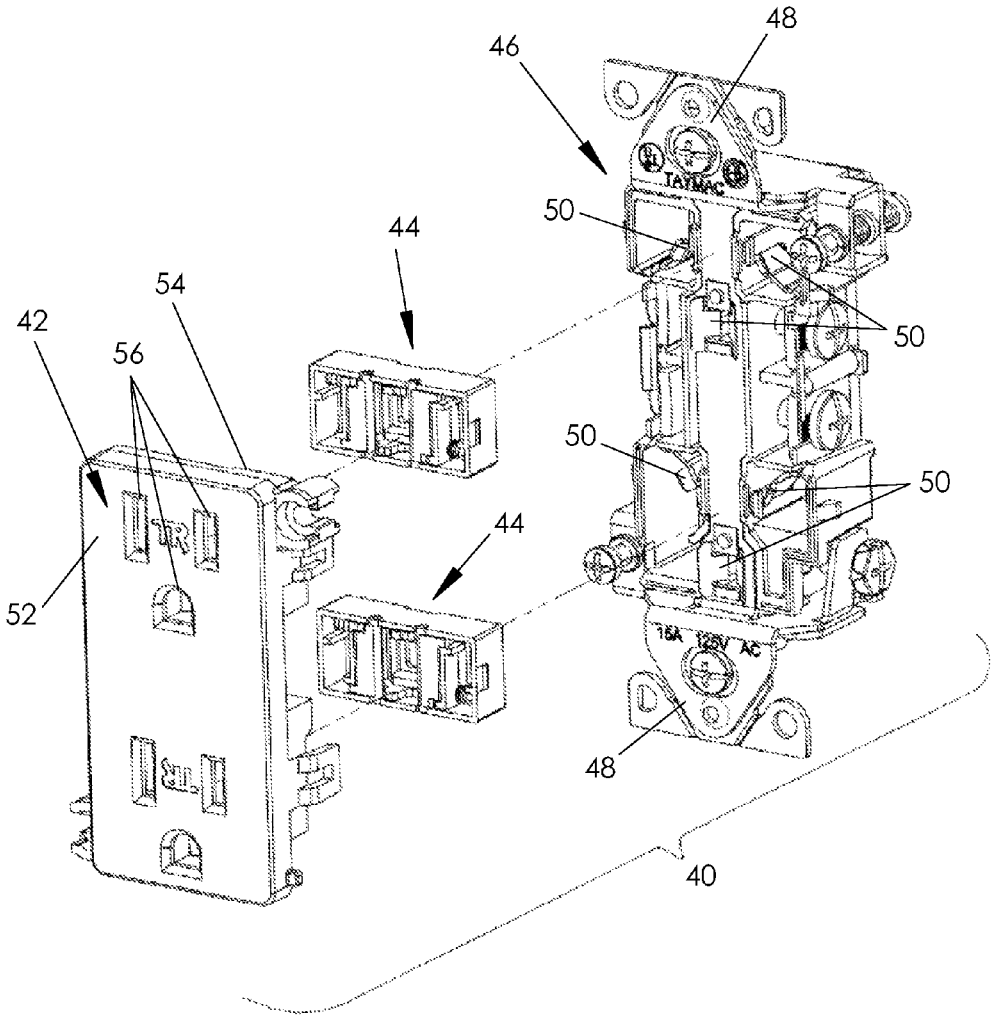
FIG. 1 is an exploded perspective view of an electrical receptacle with a tamper resistant shutter system.
Figure 2A:
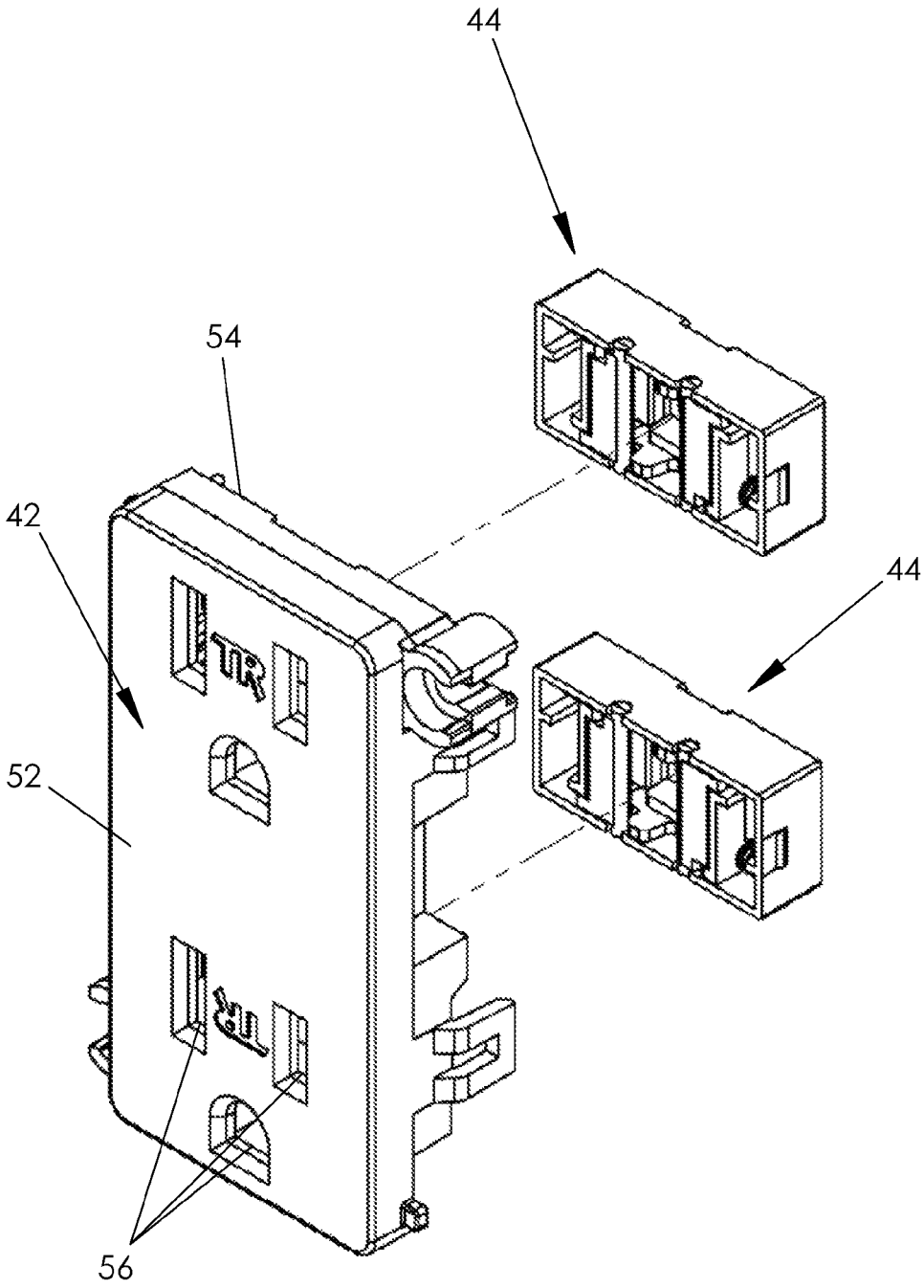
FIG. 2A is an exploded perspective view of an electrical receptacle face with a tamper resistant shutter system.
Figure 2B:
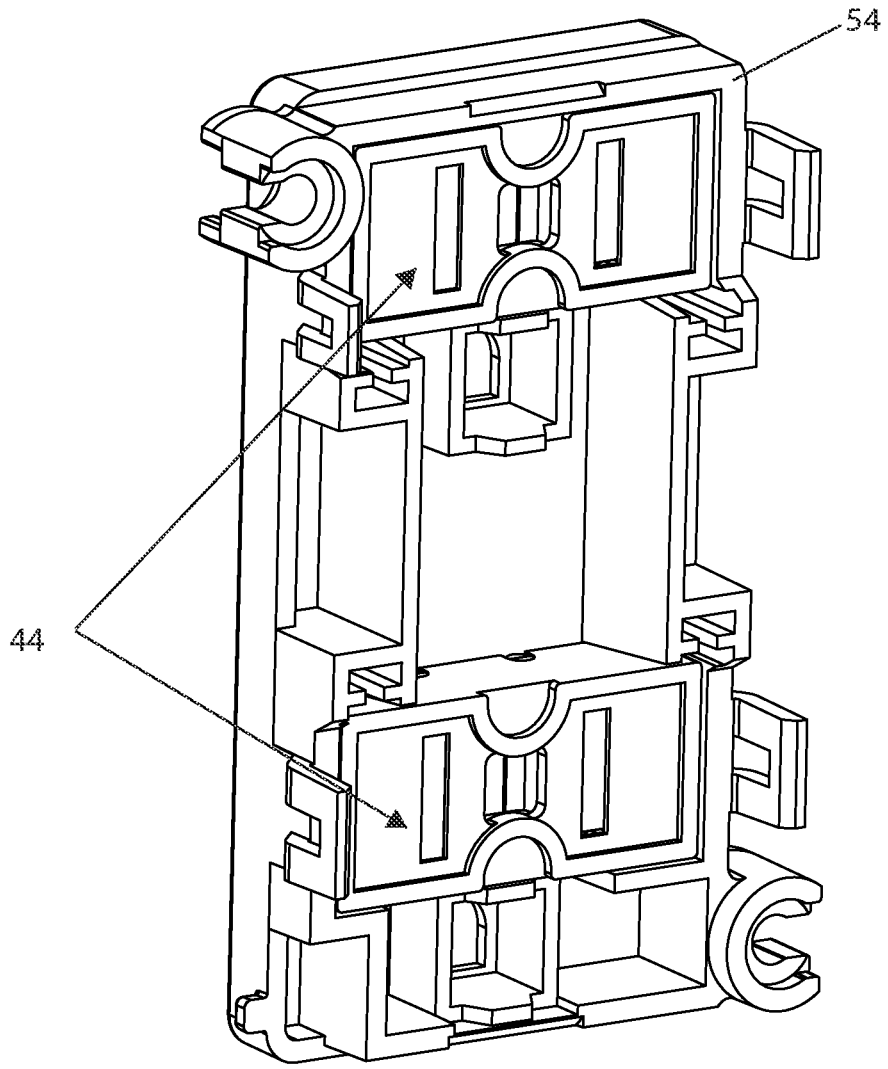
FIG. 2B is a rear perspective view of an electrical receptacle face with a tamper resistant shutter system.

Accordingly, there are a variety of tamper resistant electrical devices and electrical cords.

FIGS. 1 through 4 illustrate a tamper resistant electrical device 40 that includes a device face 42, with a pair of tamper resistant shutter systems 44 and a conductive structural portion 46. The conductive structural portion 46 houses a yoke 48, electrical contacts 50 which receive the electrical plug prongs, and mounting hardware for connecting the electrical device to wiring.

Device face 42 includes a front surface 52 and a rear surface 54. A plurality of openings 56 extend through front surface 52 and rear surface 54 to permit electrical plug prongs to engage electrical contacts 50. Electrical contacts 50 are aligned with openings 56 to ensure that the electrical plug prongs can engage the electrical contacts during normal operation, but electrical contacts 50 are generally protected from inadvertent engagement. In general, the remainder of the conductive structural portion 46 may be similar to a standard electrical device or may incorporate an adjustability system as shown in FIG. 1, and disclosed in further detail in U.S. patent application Ser. No. 12/890,511 to Baldwin et al., the disclosure of which is incorporated herein by reference.

Figure 3:
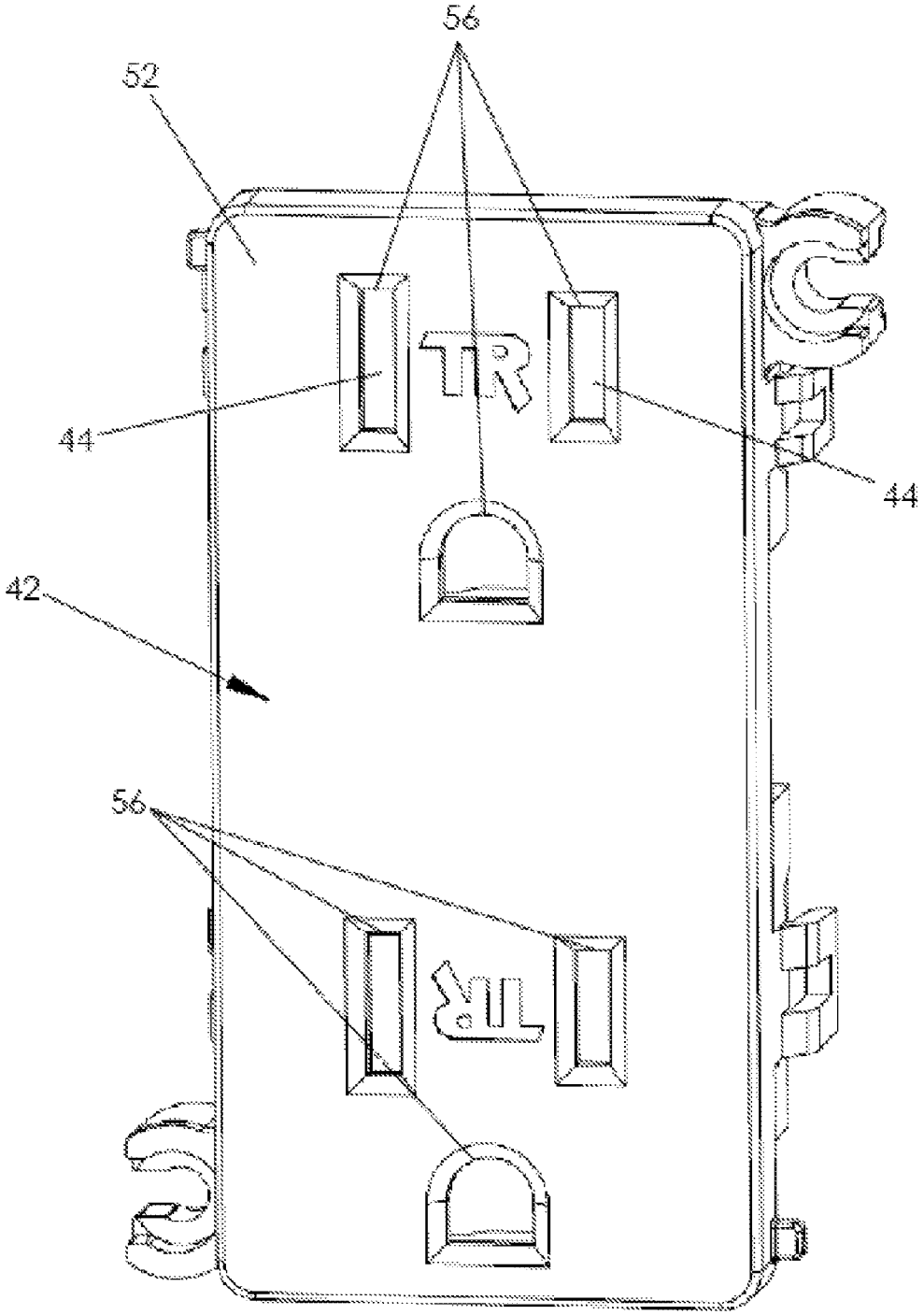
FIG. 3 is a front elevation view of an electrical receptacle face with a tamper resistant shutter system in the closed position.
Figure 4:
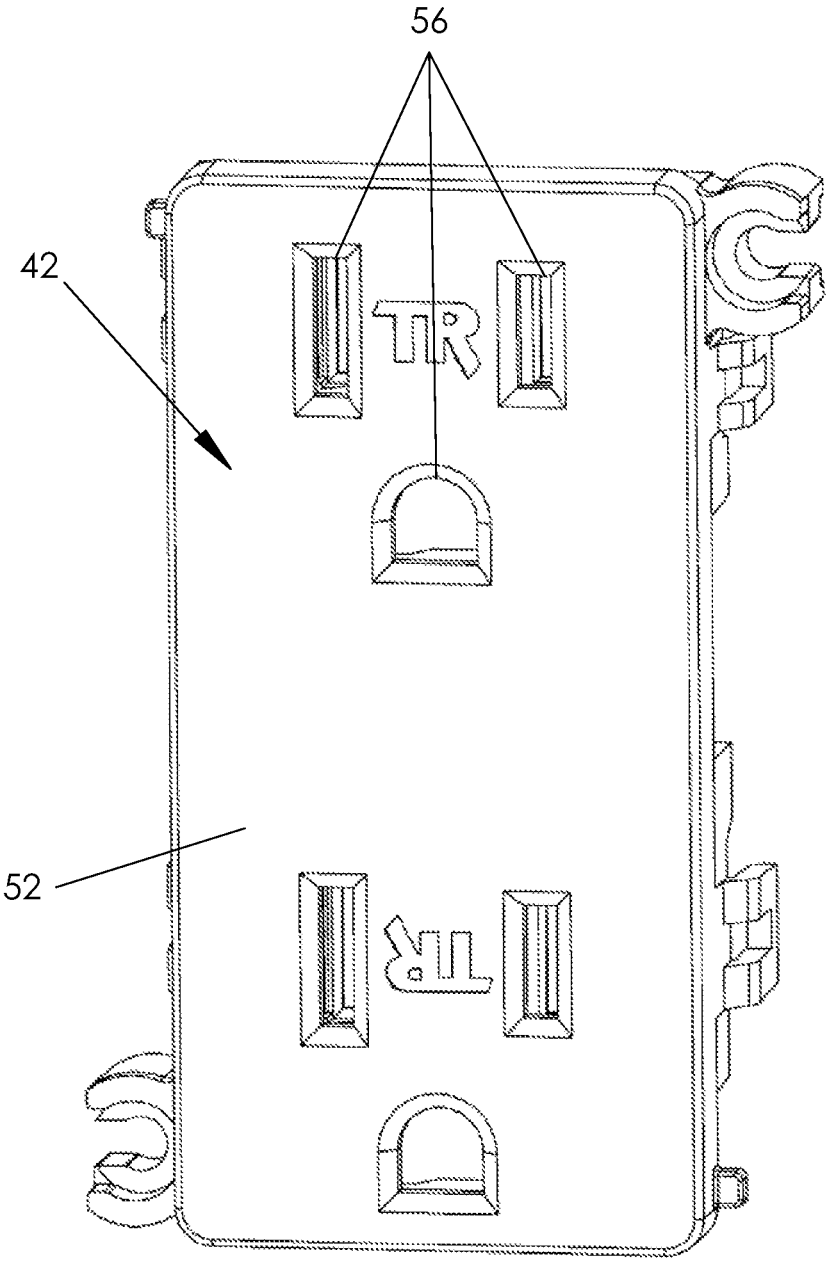
FIG. 4 is a front elevation view of an electrical receptacle face with a tamper resistant shutter system in the open position.

Referring to FIGS. 3 and 4, tamper resistant shutter system 44 is shown in the closed position and open position, respectively. As seen in FIG. 3, tamper resistant shutter system 44 is preventing a child or other user from inserted a foreign object into the receptacle opening. FIG. 4, on the other hand, illustrates after an electrical plug has penetrated tamper resistant shutter system 44 and permitted the prongs to engage the electrical contacts therein. In one aspect, the tamper resistant shutter system may only block the two flat, parallel, non-coplanar blades of a three prong electrical plug. Thus, the grounding opening may not be protected because electrical current will not flow from the grounding opening and harm a user. In another aspect, the grounding opening may also include a tamper resistant shutter system that works in conjunction with or separate from a tamper resistant shutter system operating with the flat plug blades.

FIGS. 5 through 11 illustrate first aspect tamper resistant shutter system 44 in greater detail. Shutter system 44 may include a housing 58 having a cavity 60 in the front, which is arranged to receive the various tamper resistant components in one aspect detailed below.

Figure 5:
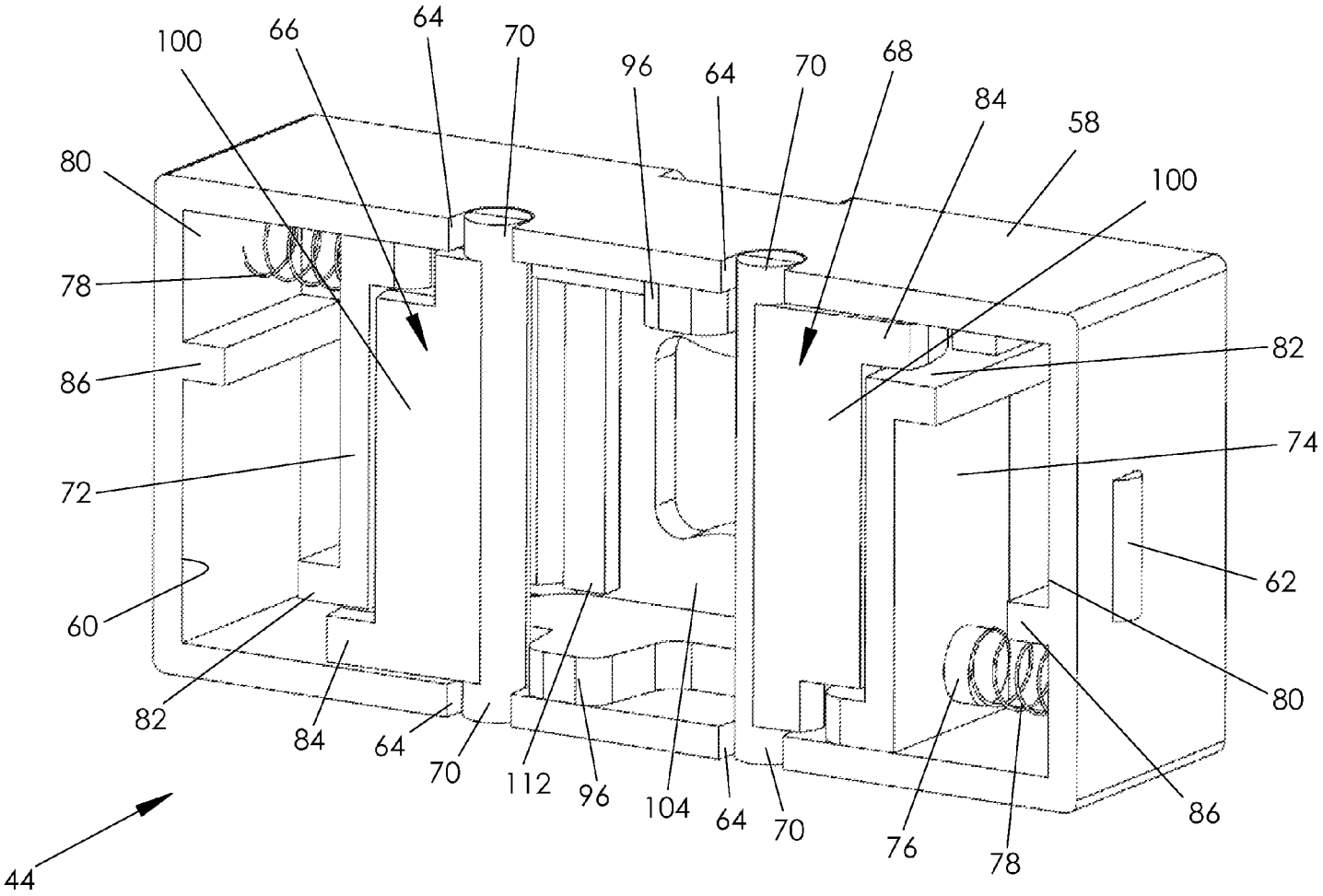
FIG. 5 is a perspective view of a tamper resistant shutter system in an assembled state.

FIG. 5 illustrates tamper resistant shutter system 44 in the assembled state and in the closed position. Housing 58 is preferably shaped and sized to fit directly behind device face 42 adjacent rear surface 54. A pair of mounting tabs 62 may be located on the outer sides of shutter system housing 58 to provide a compression fit adjacent device face rear surface 54. Housing 58 may also include a plurality of grooves 64, with two grooves on each of the two longer housing walls in one aspect.

In this arrangement, a first shutter member 66 is rotatably mounted within two grooves 64 on a left side of the housing, while a second shutter member 68 is rotatably mounted within two grooves 64 on a right side of the housing. Both first shutter member 66 and second shutter member 68 include a pivot shoulder 70 extending from each side of each member. The pivot shoulders are shaped and sized complimentary to grooves 64 and rest within the grooves to provide rotational movement of the first and second shutter members with minimal friction.

Tamper resistant shutter system 44 also includes a third shutter member 72 behind first shutter member 66, while a fourth shutter member 74 is located behind second shutter member 68. Both third shutter member 72 and fourth shutter member 74 include a protrusion 76 arranged to receive a spring 78 therein which contacts an inner wall 80 of housing 58. The third and fourth shutter members may also include a perpendicular end 82 which may be located distal the respective spring 78 and spaced apart a distance approximately equal to a finger 84 on each of the first and second shutter members. Further, a separation wall 86 may extend inward from inner surface 80 and help to locate and maintain the location of spring 78 on the inner surface. While springs 78 (and all other springs disclosed herein) are shown and described as being compression or coil springs, any suitable biasing member may be incorporated without departing from the spirit of the disclosure. Such additional biasing members may include spring steel, torsion springs, tension springs, flat springs, or any other suitable biasing member.

Figure 6:
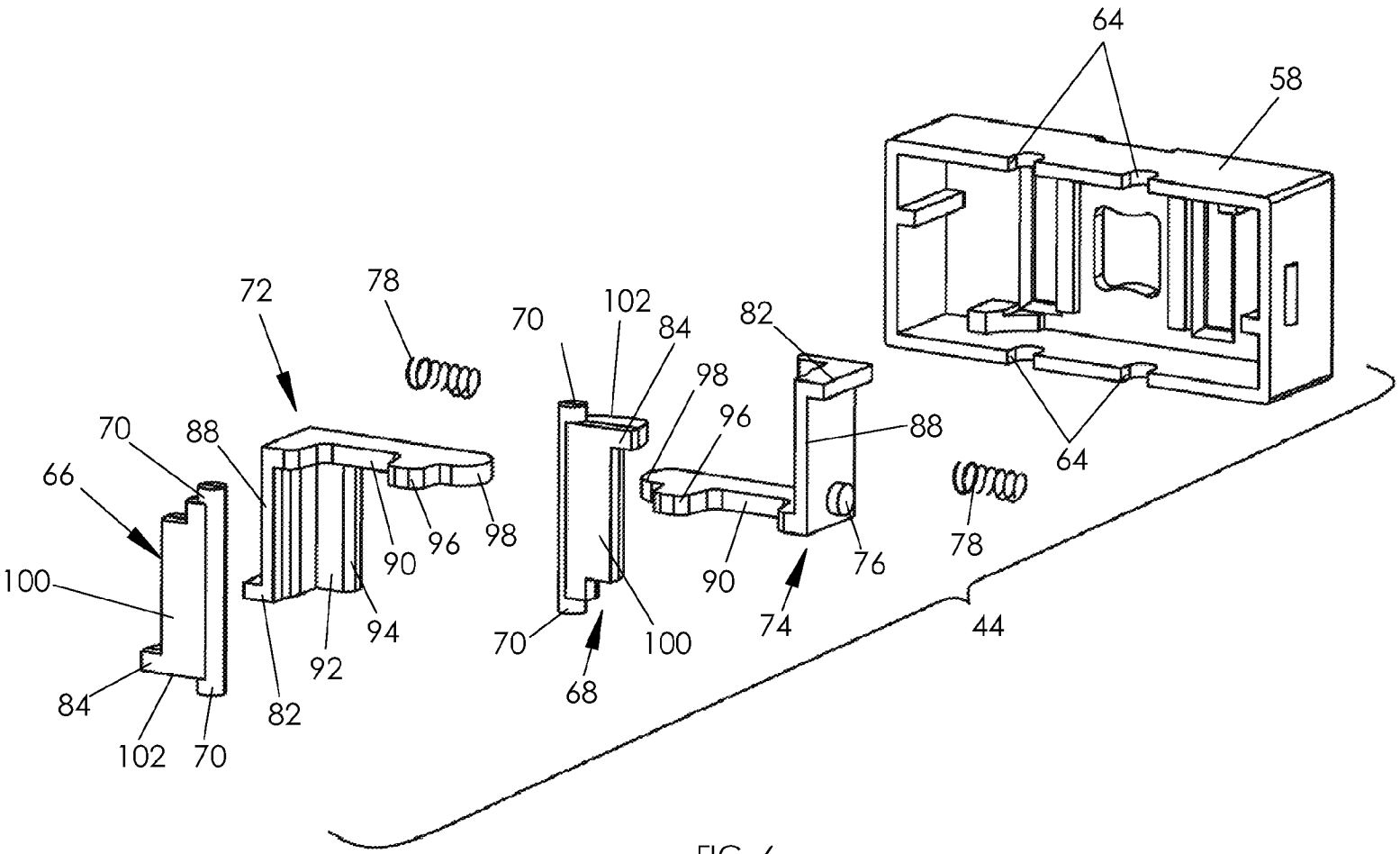
FIG. 6 is an exploded perspective view of a tamper resistant shutter system.

FIG. 6 illustrates a tamper resistant shutter system 44 with the shutter members and springs exploded from housing 58. Both the third shutter member and the fourth shutter member include similar structure, but are oriented generally 180 degrees from one another within housing 58. Thus, both the third shutter member and the fourth shutter members include a short side 88 and a long side 90. Short side 88 may be located in the path of the electrical plug prongs to selectively prevent access to the electrical contacts below, while long side 90 may be oriented generally perpendicular to the short side. Short side 88 includes protrusion 76 and protrusion end 82 on a back side of each short side, while a blocking ledge 92 with a tapered end 94 is located on a front side. Long side 90 extends from the front side of the short side opposite perpendicular end 82 and each includes a guide 96 and an arm 98 extending beyond the guide.

First and second shutter members 66 and 68 each include a blocking surface 100 located between pivot shoulders 70 and extending for at least the width of each opening 56 in the device face. Advantageously, blocking surface 100 initially prevents access to the electrical device contacts, while blocking ledge 92 of the third and fourth shutter members provides a secondary level of protection from the contacts. Still further, both the first and second shutter members each include a rounded engagement portion 102 extending below and forming part of finger 84. Rounded engagement portion 102 is preferably rounded to contact arm 98 of the third and fourth shutter members during operation. As will be described in greater detail below, both rounded engagement portion 102 of the first and second shutter members and arms 98 of the third and fourth shutter members are rounded and/or complimentary shaped to one another so that during pivotable or rotational movement of the first and second shutter members, the third and fourth shutter members are linearly actuated or displaced by the respective first and second shutter members' rotational movement.

Figure 7:
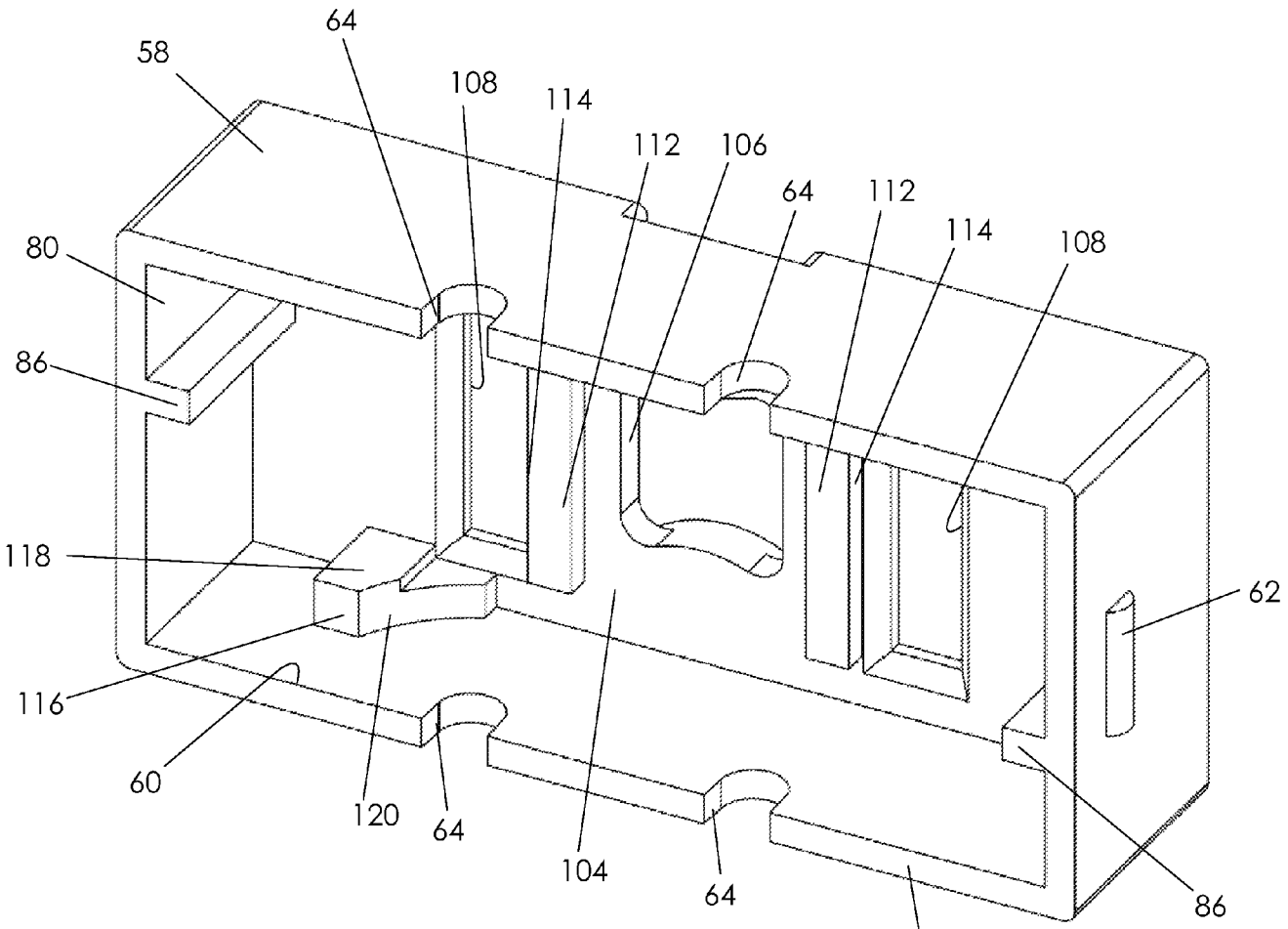
FIG. 7 is a perspective view of a tamper resistant shutter system housing.

FIG. 7 illustrates shutter housing 58 without shutter members present. Shutter member housing 58 includes a base wall 104 with a central opening 106 and apertures 108 arranged to receive electrical plug prongs after passing through the tamper resistant shutter members. The shutter member housing also includes a perimeter front surface 110 extending along the width of the tamper resistant shutter system and located adjacent rear surface 54 of the device face after installation.

Base 104 also includes a linear stop 112 having a raised edge 114 on the side of the linear stop closest to the respective aperture 108. Raised edge 114 is used to limit the linear travel of the respective third and fourth shutter members in the closed position while the lower shutter members (third and fourth shutter members) are each biased by a spring into the raised edge 114 of the linear stops 112 adjacent apertures 108. The base 104 also includes a pair of platforms 116 having a guide edge 118 and a curved portion 120. Platforms 116 extend upward from base 104 with one platform 116 near each aperture 108 and the curved portion 120 oriented in the direction of the nearest upper shutter member (first or second shutter member) so that the first or second shutter members and the rounded engagement portion can pivot freely without interruption. Still further, guide edge 118 functions to align the respective lower shutter member during linear movement and prevent the lower shutter from binding or contacting other components. In one aspect illustrated in FIG. 7, a platform 116 is located in the top right and bottom left of the shutter housing, although the platforms 116 may be located in any location so long as they assist in guiding the lower shutter members and do not interfere with the movement and operation of the upper shutter members.

Figure 8:
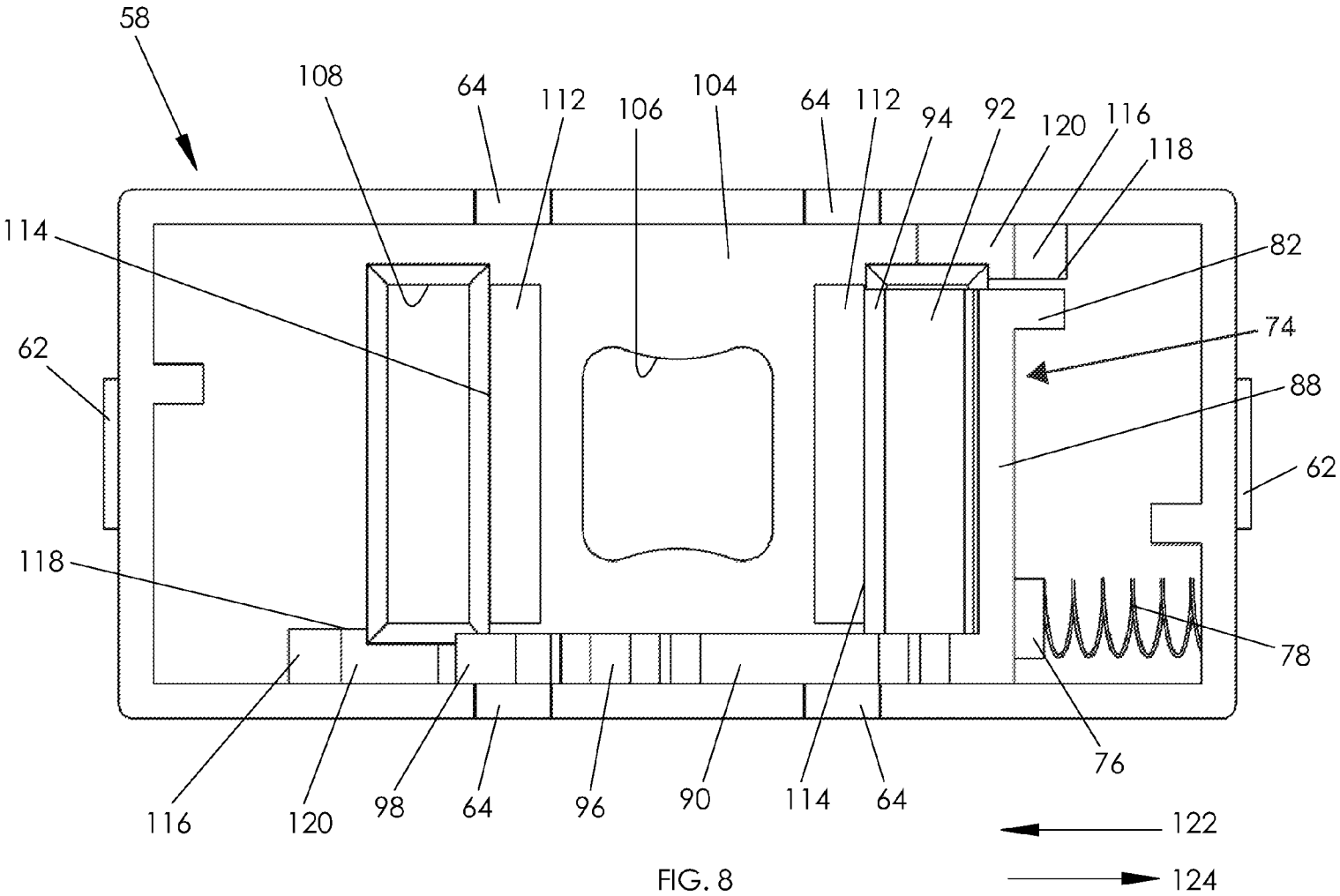
FIG. 8 is a front elevation view of a tamper resistant shutter system housing with a fourth shutter member in position.

FIG. 8 illustrates fourth shutter member 74 positioned within shutter housing 58 and biased in the closed position in the direction associated with arrow 122 by spring 78. As can be seen, the blocking ledge 92 covers apertures 108 and prevents a foreign object from reaching the aperture. Tapered end 94 contacts linear stop 112 and particularly raised edge 114 of the linear stop to maintain the fourth shutter member in the closed position. Further, guide end 118 helps to maintain the lower shutter members in position along with walls of the shutter housing 58.

The fourth shutter member 74 is linearly or slidably moveable to an open position by moving fourth shutter member 74 in the direction associated with arrow 124. First shutter member 66, not shown in FIG. 8 is oriented above long side 90 of fourth shutter member 74. Specifically, finger 84 and rounded engagement portion 102 of the finger is oriented adjacent arm 98 of the fourth shutter member. When first shutter member 66 rotates about pivot shoulders 70, rounded engagement portion 102 contacts the complimentary shaped arm 98 and imparts linear or sliding movement of the fourth shutter member in the direction associated with arrow 124. The movement in the direction associated with arrow 124 includes sufficient force to overcome the resistance of spring 78 and thereby moves short side 88 of the fourth shutter member from in front of apertures 108. While the movement directions are specific to the aspects disclosed in FIG. 8, it is within the spirit and scope of the disclosure to orient the shutter members in any number of suitable manners, as well as arrange the shutter members to pivot in the same directions or opposite directions.

Figure 9:
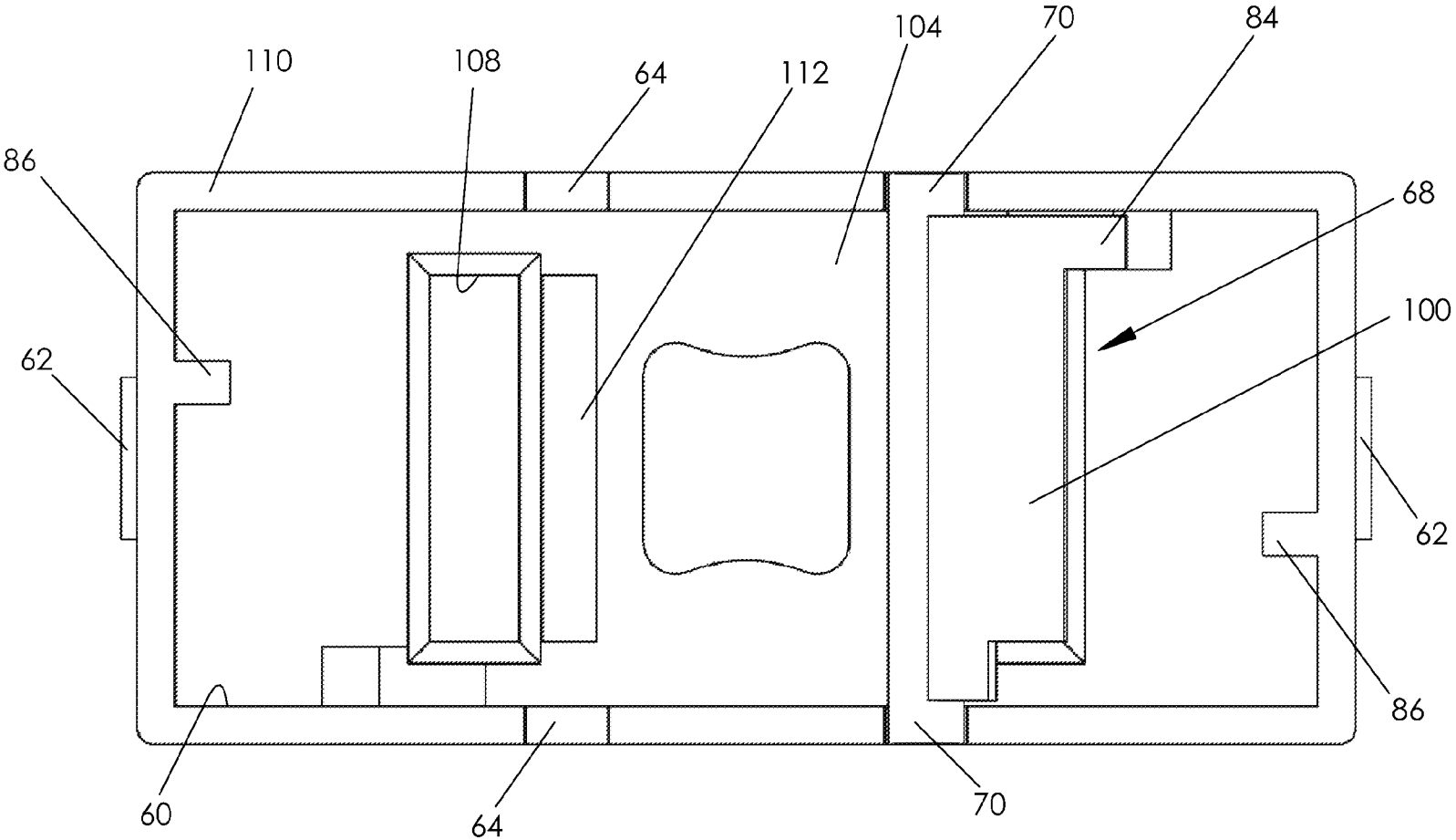
FIG. 9 is a front elevation view of a tamper resistant shutter system housing with a second shutter member in position.

FIG. 9 illustrates second shutter member 68 in the closed position and mounted within shutter housing 58. As discussed above, pivot shoulders 70 are pivotably located within grooves 64 in the perimeter front surface 110. Blocking surface 100 is shown preventing access to the electrical contacts and is pivotably moveable to the open position by an object contacting the blocking surface. When the object contacts blocking surface 100, a moment is created along the axis aligned with pivot shoulders 70, thereby causing the second shutter member 68 to rotate about the pivot shoulders. Nevertheless, the second shutter member imparts linear or sliding movement on the third shutter member (not the fourth shutter member), and thereby does not permit access to the electrical contacts behind the second shutter member. In the same manner, the first shutter member rotational movement imparts linear or sliding movement on the fourth shutter member, thereby preventing access to the electrical contacts behind the first shutter member by only pivoting the first shutter member to the open position. One of ordinary skill in the art will immediately understand that both the first and second shutter members must be moved to the open position before the electrical contacts therein can be reached, thereby preventing unauthorized access to the electrical device contacts.

Figure 10:
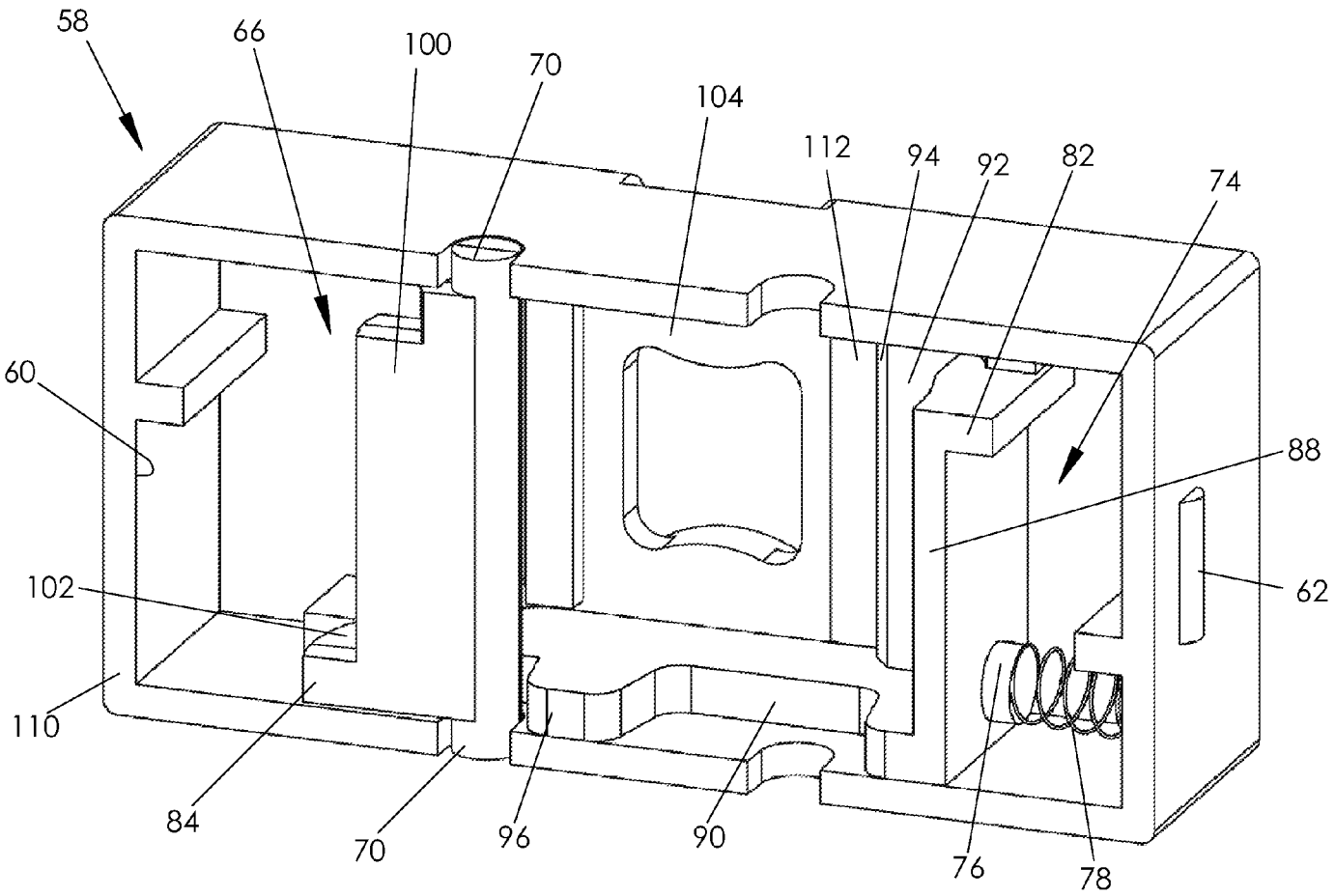
FIG. 10 is a perspective view of a tamper resistant shutter system housing with a first shutter member and a fourth shutter member in position.

FIG. 10 illustrates first shutter member 66 and fourth shutter member 74 mounted within shutter housing 58. The second and third shutter members have been removed for clarity, although the function and operation of the shutter assembly remains the same for the second and third shutter members. As seen in the closed position, first shutter member 66 and blocking surface 100 prevent access to the electrical contacts on the left side as a first layer of protection. The first shutter member is operatively connected to only the fourth shutter member, therefore only movement of the first shutter member 66 will impart movement on the opposite side fourth shutter member 74. As previously disclosed, rotating an upper shutter member (either the first or second shutter members) functions to permit the object to bypass the upper shutter member, but the lower shutter member (either the third or fourth shutter members) prevent access because only the opposing side upper shutter member can permit the object to pass the lower shutter member by sliding the lower shutter member open.

Figure 11:
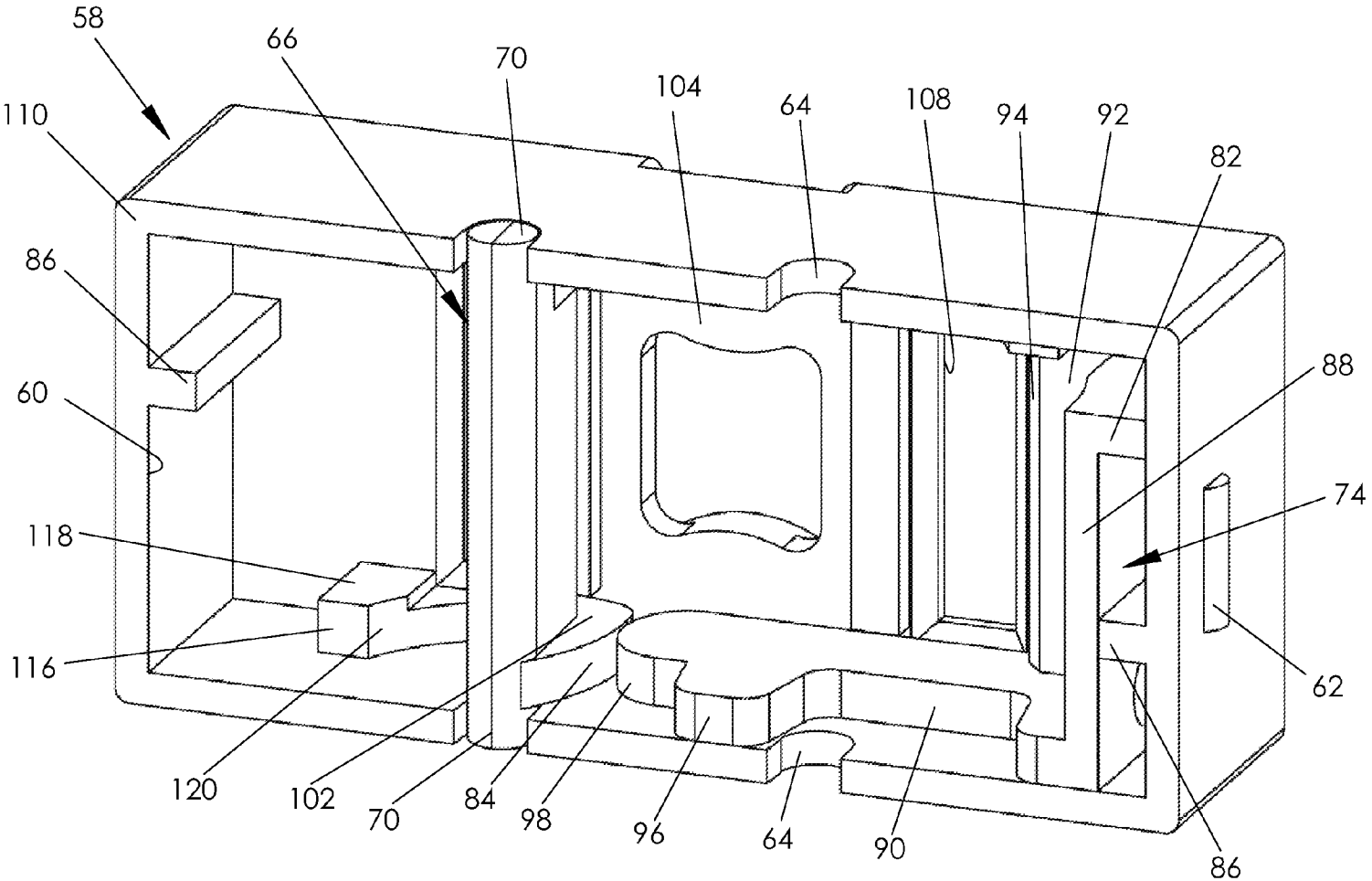
FIG. 11 is a perspective view of a tamper resistant shutter system housing with a first shutter member and a fourth shutter member in position and both shutter members in the open position.
Figure 12:
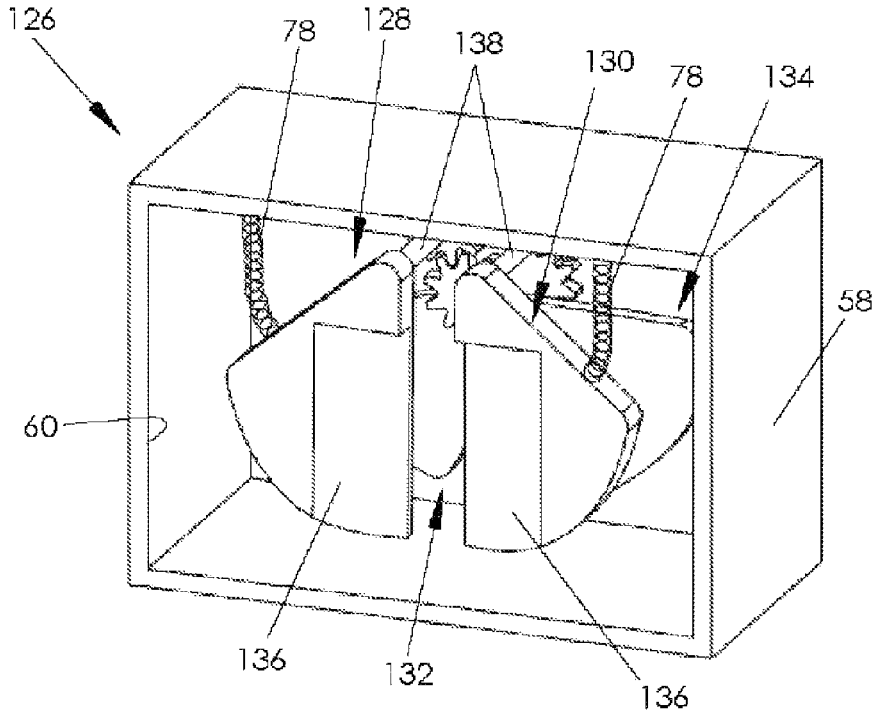
FIG. 12 is a perspective view of a second aspect tamper resistant shutter system in an assembled state.
Figure 13:
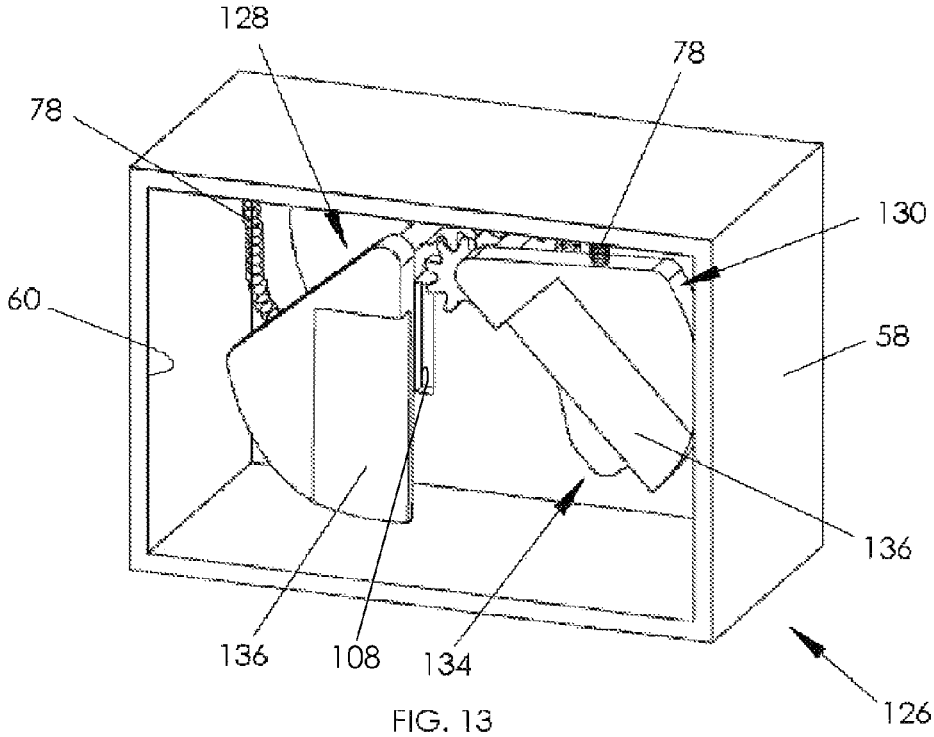
FIG. 13 is a perspective view of a second aspect tamper resistant shutter system with a second shutter member and a third shutter member moved to an open position.

FIG. 11 illustrates first shutter member 66 and fourth shutter member 74 mounted within shutter housing 58 in the open position. Specifically, blocking surface 100 has been contacted by an object, creating a moment at pivot shoulders 70 and grooves 64 to create pivotable movement of the first shutter member. As first shutter member 66 pivots to the open position, rounded engagement portion 102 of finger 84 contacts arm 98 of long side 90 on fourth shutter member 74. The contact between rounded engagement portion 102 and arm 98 forces fourth shutter member 74 to the open position as the first shutter member rotates to the open position. As the first shutter member rotates to the open position, finger 84 and rounded engagement portion 102 extend further in the direction of the fourth shutter member as the first shutter member continues to rotate open.

While FIGS. 10 and 11 illustrate only the interaction between the first and fourth shutter members, the interaction between the second and third shutter members is identical, only mirrored. Thus, the second and third shutter members and the first and fourth shutter members operate as separate units, with the common purpose of preventing unauthorized access to the electrical contacts, unless both the first and second shutter members are pivoted to the open position.

During assembly and operation, the shutter housing, first shutter member, second shutter member, third shutter member, fourth shutter member, and springs may each be formed separately. Springs 78 are installed on protrusions 76 and the third and fourth shutter members are located within shutter housing 58 with springs 78 contacting inner surface 80 and the third and fourth shutter member blocking ledges 92 contacting the respective linear stops 112. Next, first and second shutter members are located within shutter housing 58, with pivot shoulders 70 located within grooves 64. When the first and second shutter members (upper shutter members) are initially installed, they are in a relaxed state without the springs providing reactive forces on the upper shutter members. When upper shutter members are rotated to the open position, each opposite lower shutter member (the third and fourth shutter members) are slidingly or linearly moved against the extension force of the respective spring to open the lower shutter members. When the lower shutters are in the open position, a restoring force is provided by the springs, which slides the lower shutter members to the closed position. Sliding the lower shutter members to the closed position operates to move arm 98 of the lower shutter member in the direction of the finger 84 and contacts the rounded engagement portion 102, which forces the respective upper shutter member to rotate to the closed position. Once all four shutter members and the springs are installed, the shutter housing is installed on the rear surface of the electrical device face and mounting tabs 62 engage the electrical device face to mount the shutter housing. Accordingly, the shutter system is self-contained within the shutter housing and the electrical device face and prevents unauthorized access to the electrical contacts located in line with the tamper resistant shutter system.

As disclosed in FIGS. 1 through 11, the first and second shutter members pivot instead of slide from the closed position to the open position. The first and second shutter members pivot towards one another in the direction of the electrical plug insertion or in the direction of the electrical contacts. One of ordinary skill in the art will immediately recognize that the first and second shutter members may rotate in the direction of the electrical plug insertion but at the same time rotate away from each other and pull, instead of push the lower shutter members to the open position or any combination thereof.

FIGS. 12 through 18 illustrate a second aspect tamper resistant shutter system 126. Tamper resistant shutter system 126 includes a first shutter member 128, a second shutter member 130, a third shutter member 132, and a fourth shutter member 134. Similar to the first aspect, first shutter member 128 and second shutter member 130 function as upper level shutter members which are contacted first and operate to open the lower shutter member (third shutter member 132 and fourth shutter member 134) as necessary.

Both the first and second shutter members may include an angled contact surface 136 aligned to receive the electrical plug blades during use. The first and second shutter members are pivotably mounted within housing 58 along mounting rods 138 and the force generated by inserting the electrical plug forces the first and second shutter members to pivot in a direction perpendicular to the direction of the electrical plug insertion. Specifically, the first and second shutter members may pivot away from each other and against their respective springs 78, that are biasing the first and second shutter members into the closed position. Thus, when the electrical plug is removed, the spring biases the respective shutter member into the closed position. While the figures illustrate the first and second shutter members pivoting away from one another, one of ordinary skill in the art will immediately recognize that the shutters could pivot toward one another.

Figure 14:
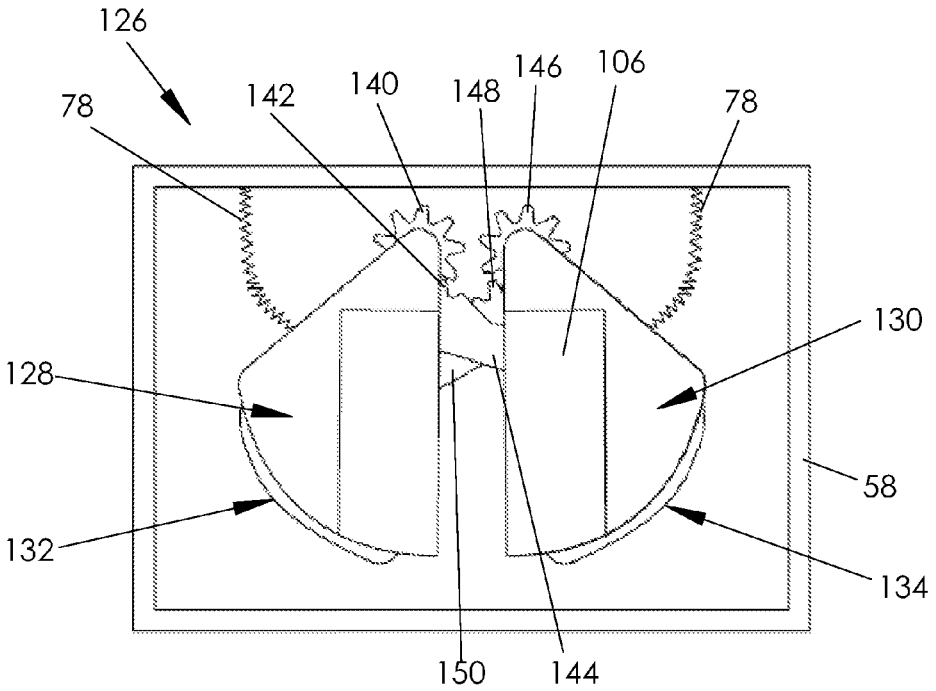
FIG. 14 is a front elevation view of a second aspect tamper resistant shutter system in an assembled state.
Figure 15:
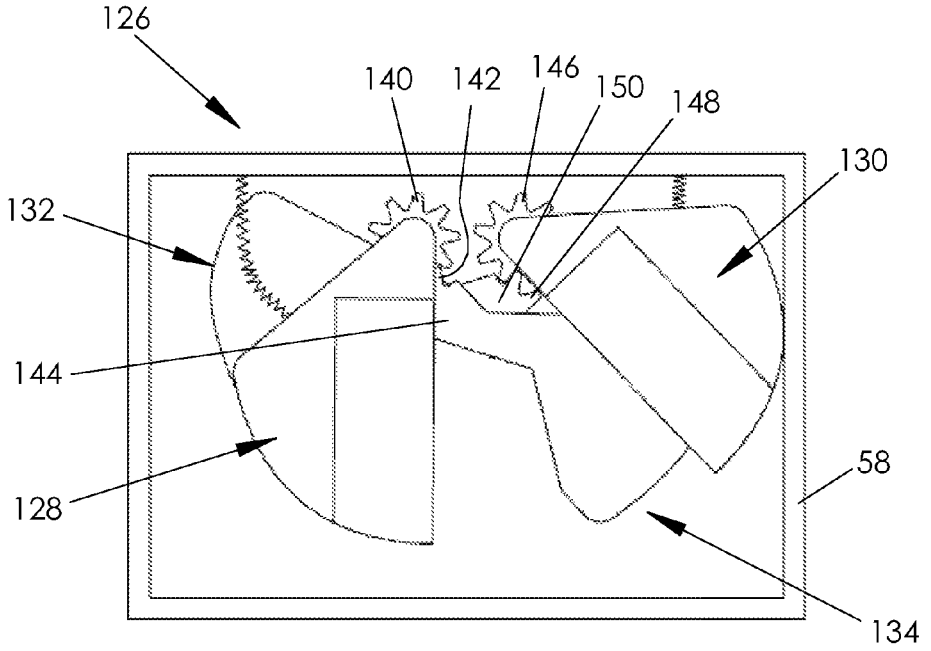
FIG. 15 is a front elevation view of a second aspect tamper resistant shutter system with a second shutter member and a third shutter member moved to an open position.
Figure 16:
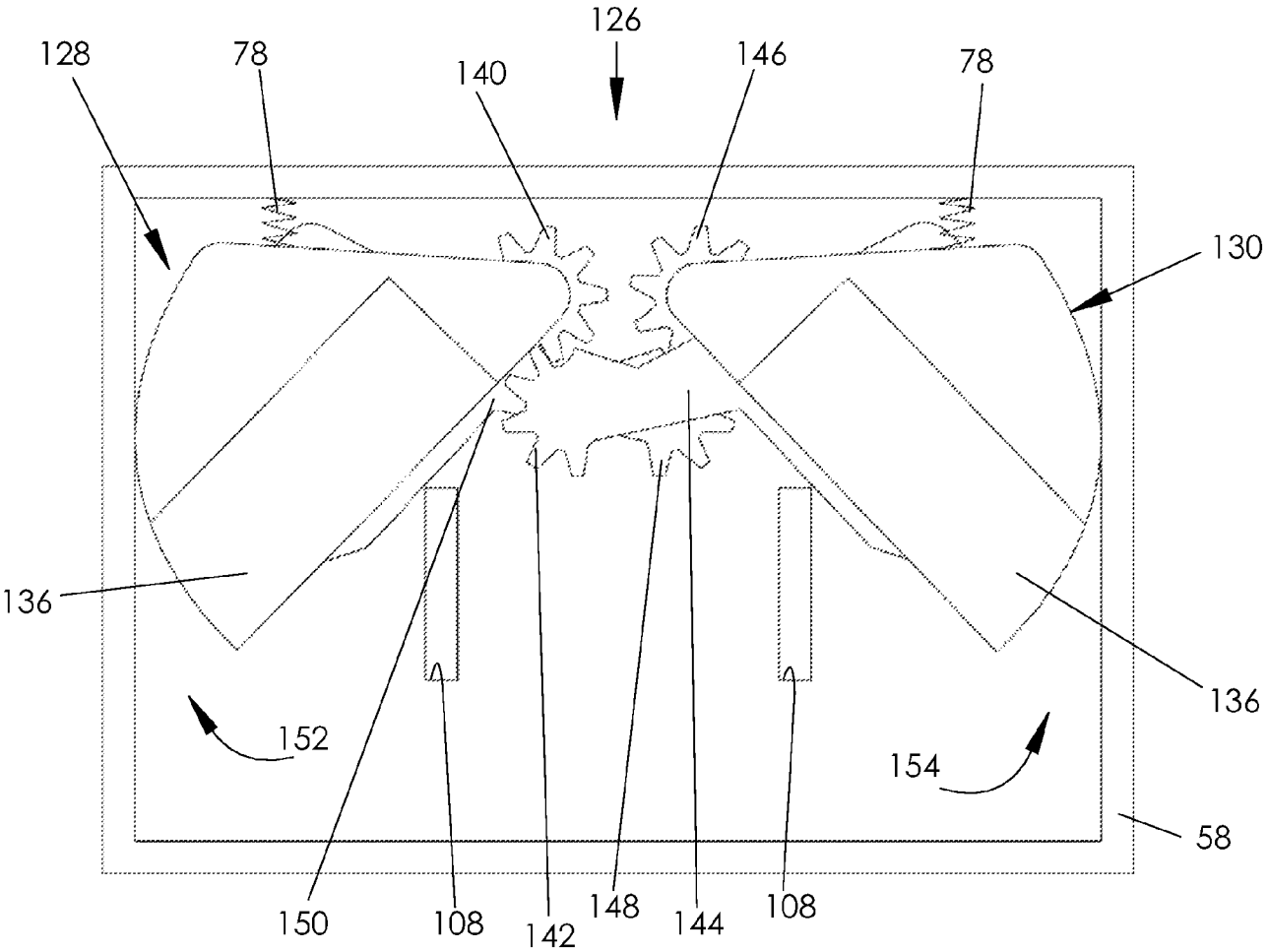
FIG. 16 is a front elevation view of a second aspect tamper resistant shutter system with all four shutter members moved to an open position.

Referring to FIGS. 14 through 16, the first shutter member includes a gear 140 on mounting rod 138 that includes teeth to engage teeth 142 on a connecting rod 144 of fourth shutter member 134. In a similar manner, second shutter member 130 includes a gear 146 on mounting rod 138 that includes teeth to engage teeth 148 on a connecting rod 150 of third shutter member 132. Mounting rods 140 of the first and second shutter members are approximately the same length so that the first and second shutter members are located the same distance from the electrical device face and apertures 108. However, gears 140 and 146 are preferably staggered along the length of mounting rods 138 so that they can each connect to the opposite side shutter member during operation (i.e. the first shutter member operates the fourth shutter member and the second shutter member operates the third shutter member).

FIG. 16 illustrates both the first and second shutter members pivoted to the open position. First shutter member 128 pivots open in the direction associated with arrow 152, while second shutter member 130 pivots open in the direction associated with arrow 154. As discussed above, gears 140 and 146 are offset from one another and therefore teeth 142 and 148 are offset from one another so that teeth 142 are rotatably engaged with gear 140 and teeth 148 are rotatably engaged with gear 146. Accordingly, any rotational movement of first shutter member 128 imparts rotational movement at gear 140 and teeth 142 which translates into rotational movement in the opposite direction at connecting arm 144. Similarly, any rotational movement of second shutter member 130 imparts rotational movement at gear 146 and teeth 148 which translates into rotational movement in the opposite direction at connecting arm 150. While the third and fourth shutter members are shown and described as rotating in a direction opposite to their corresponding upper shutter member, it is within the spirit and scope of the present disclosure to arrange the lower shutter members to rotate in the same direction as their corresponding upper shutter member.

Figure 17:
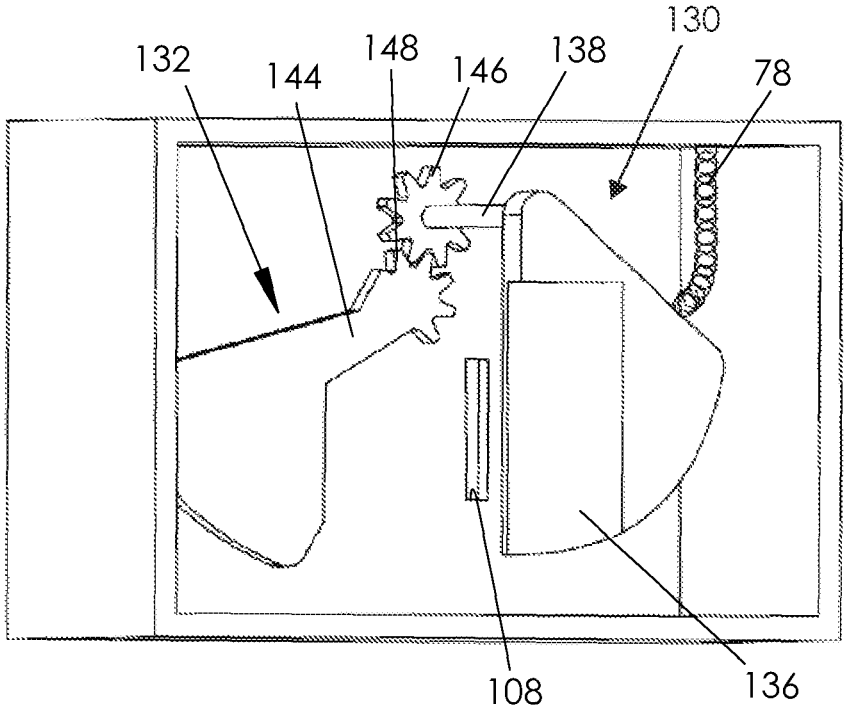
FIG. 17 is a perspective view of a second aspect tamper resistant shutter system with a second shutter member and a third shutter member in the closed position.
Figure 18:
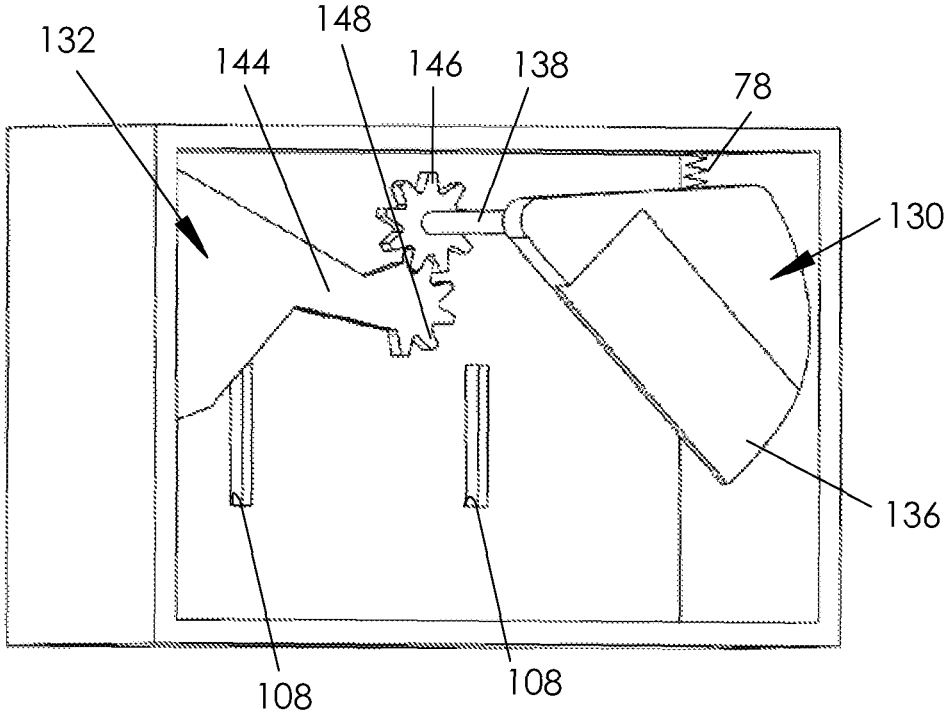
FIG. 18 is a perspective view of a second aspect tamper resistant shutter system with a second shutter member and a third shutter member in the open position.

FIGS. 17 and 18 illustrate the operation of second shutter member 130, mounting rod 138, gear 146, teeth 148, connecting rod 144, and third shutter member 132. Second shutter member 130 is biased into the closed position to cover aperture 108 by spring 78. When an electrical plug blade is inserted, the plug blade contacts angled contact surface 136 and imparts rotational movement on the second shutter member that is sufficient to overcome spring 78. As the second shutter member rotates to the open position, mounting rod 138 and gear 146 also rotate in the same direction. The rotational movement at gear 146 contacts teeth 148 and causes teeth 148 and connecting arm 144 to rotate in the opposite direction. The rotational movement of connecting arm 144 also rotates the third shutter member to the open position to expose aperture 108. Accordingly, without all four shutter members, an electrical plug can engage the electrical contacts, but with four shutter members, both upper shutter members must be rotated to the open position to move both of the lower shutter member to the open position. While particular directions of rotation are shown and described, the shutter members may pivot in the direction of the electrical plug insertion, the direction opposite the electrical plug insertion, towards one another, or away from one another without departing from the spirit and scope of the disclosure.

Figure 19:
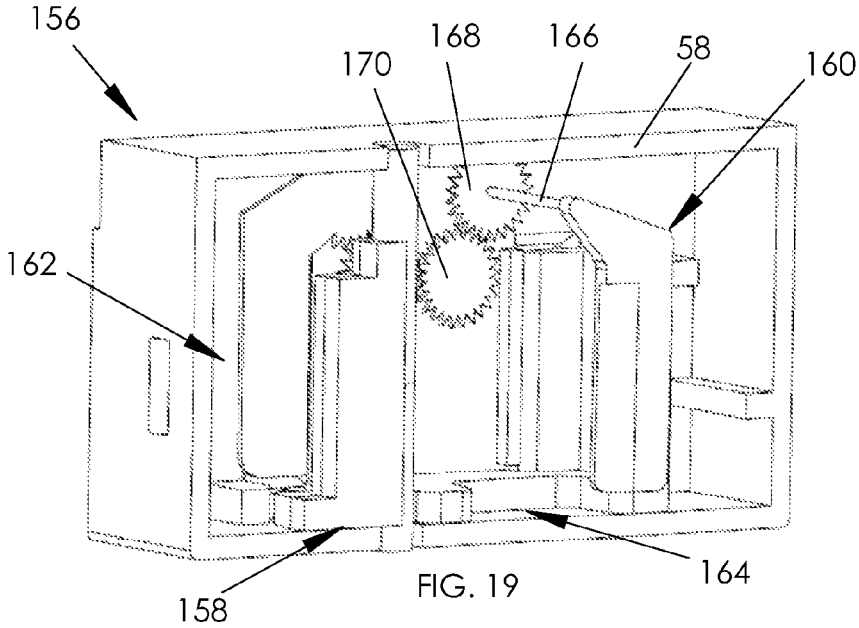
FIG. 19 is a perspective view of a third aspect tamper resistant shutter system in an assembled state.
Figure 20:
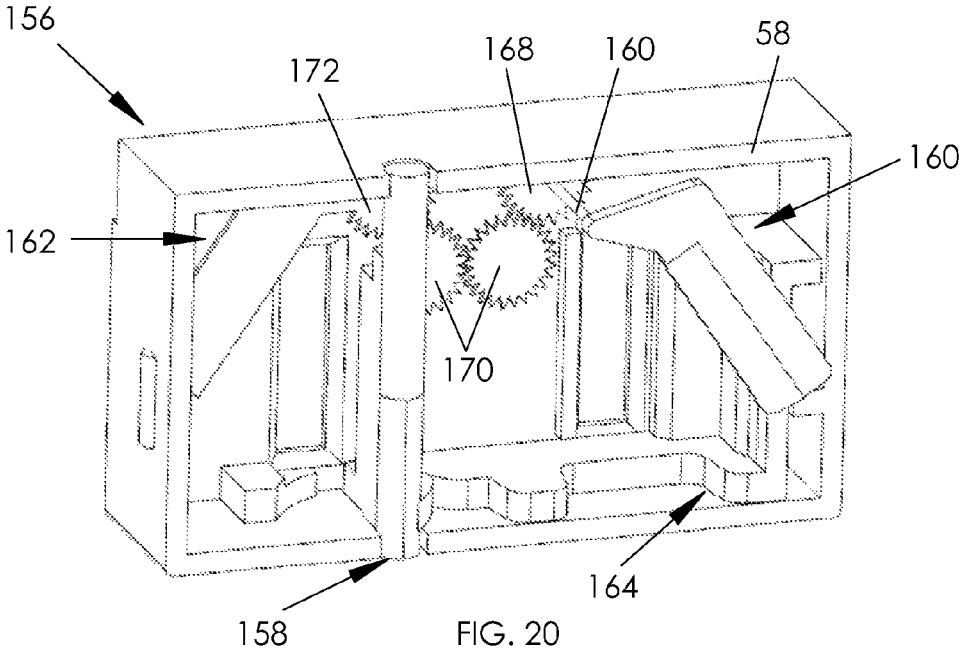
FIG. 20 is a perspective view of a third aspect tamper resistant shutter system in an open position.
Figure 21:
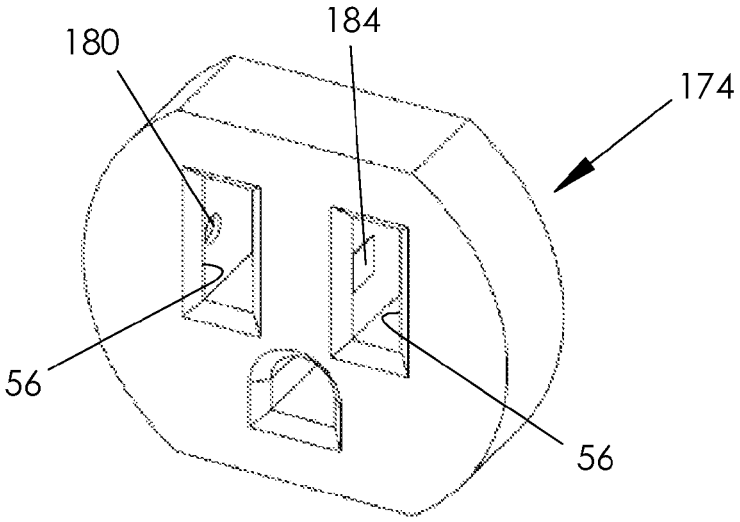
FIG. 21 is a front perspective view of a fourth aspect tamper resistant shutter system in an open position.

FIGS. 19 and 20 illustrate a third aspect tamper resistant shutter system 156. Tamper resistant shutter system 156 is a hybrid of the first two aspect tamper resistant shutter systems with one of the upper shutter members being pivotable in the direction of the electrical plug insertion, while the other upper shutter member is pivotable in a direction generally perpendicular to the electrical plug insertion direction. Still further, one of the lower shutter members pivots to the open position, while the other lower shutter member slides to the open position.

First shutter member 158 and fourth shutter member 164 are identical to first shutter member 66 and fourth shutter member 74 in both appearance and function. Second shutter member 160 and third shutter member 162 are similar to shutter members 130 and 132. Accordingly, the functionality of first shutter member 158 and fourth shutter member 164 is identical in that the first shutter member pivots in the direction of plug insertion, thereby forcing the fourth shutter member to slide to the open position. Similarly, the functionality of the second shutter member 160 is identical in that the second shutter member pivots in a direction generally perpendicular to the electrical plug insertion and is pivoted outward to rotate about a mounting rod 166. When mounting rod 166 is rotated, gear 168 is rotated, which in turn rotates idler gears 170, which in turn rotates teeth 172 of third shutter member 162 in the open position. The addition of idler gears 170 does not change the spirit and scope of the operation, but merely provides another example of many possible component orientations. Given the structural and functional similarity of the third aspect tamper resistant shutter system to the first and second aspect tamper resistant shutter systems, additional structure and operation need not be provided beyond the Figures.

FIGS. 21 through 26 illustrate a fourth aspect tamper resistant shutter system 174. Tamper resistant shutter system 174 may be formed integral to the electrical device face adjacent apertures 56 in the device face. An aperture housing 176 extends from apertures 56 into the electrical device and defines a slot 178 for receiving the electrical plug blades during operation. Each slot 178 includes a hole 180 for receiving a tripping mechanism 182. In one aspect, tripping mechanism 182 may be a photoelectric device with a reflecting mirror or receiving device 184 on the opposite side of the slot as tripping mechanism 182.

Each slot 178 is selectively enclosed on the back side by a shutter member 186 which may have a mounting rib 188 to connect the shutter member to a displacement rod 190. Displacement rod 190 may be telescopically connected to a motor 192, with a spacing shoulder 194 limiting the return travel of the displacement rod. While a telescopic displacement rod 190 is one suitable displacement means, any suitable means or method of moving shutter members 186 from the closed position to the open position may be utilized. While moving the shutter members vertically downward is illustrated in the drawings, the shutter members may be slid in any suitable direction or pivoted in any suitable direction without departing from the spirit and scope of the disclosure.

Figure 22:
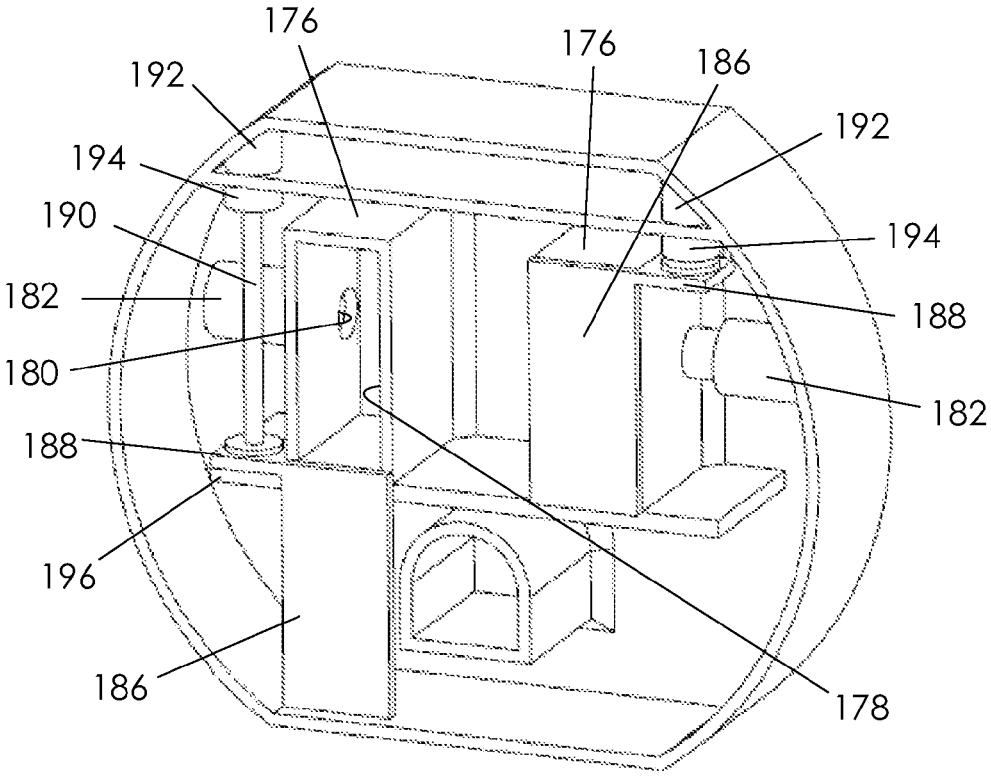
FIG. 22 is a rear perspective view of a fourth aspect tamper resistant shutter system with a first shutter member in the open position and a second shutter member in a closed position.
Figure 23:
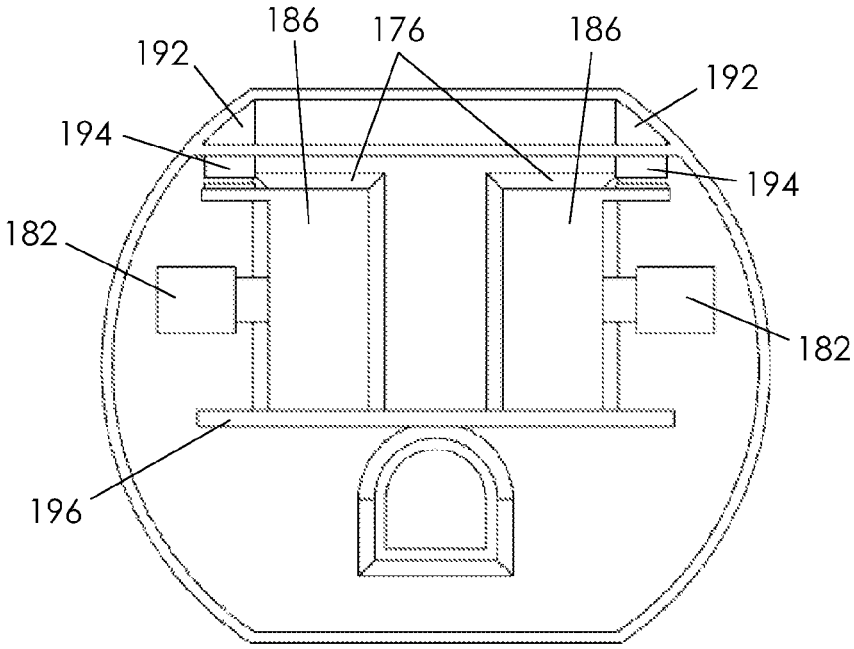
FIG. 23 is a rear elevation view of a fourth aspect tamper resistant shutter system with a first shutter member and a second shutter member in a closed position.
Figure 24:
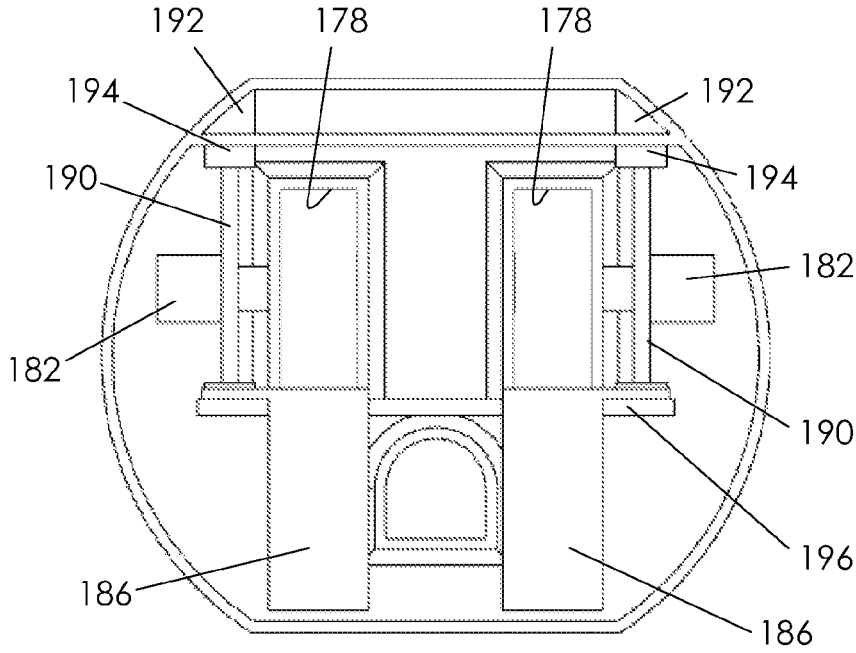
FIG. 24 is a rear elevation view of a fourth aspect tamper resistant shutter system with a first shutter member and a second shutter member in an open position.
Figure 26:
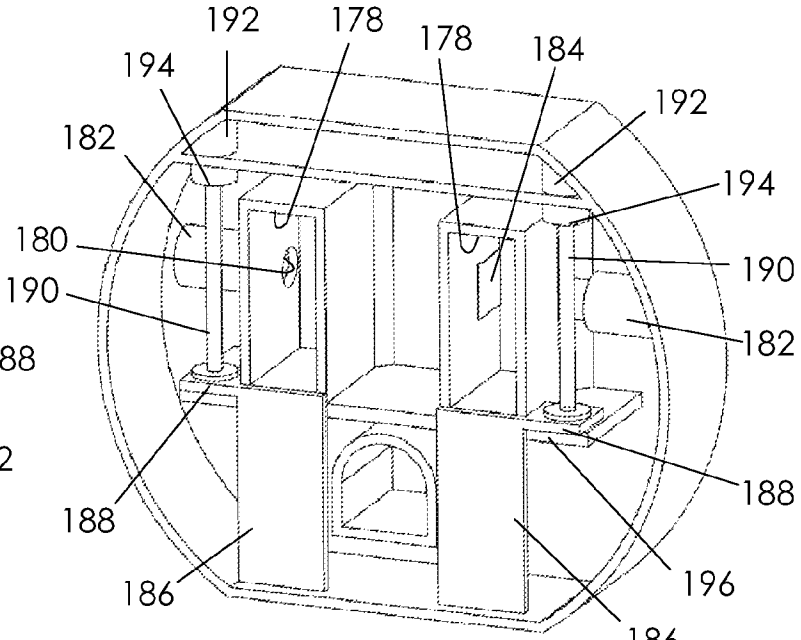
FIG. 26 is a rear perspective view of a fourth aspect tamper resistant shutter system with a first and a second shutter member in an open position.
Figure 25:
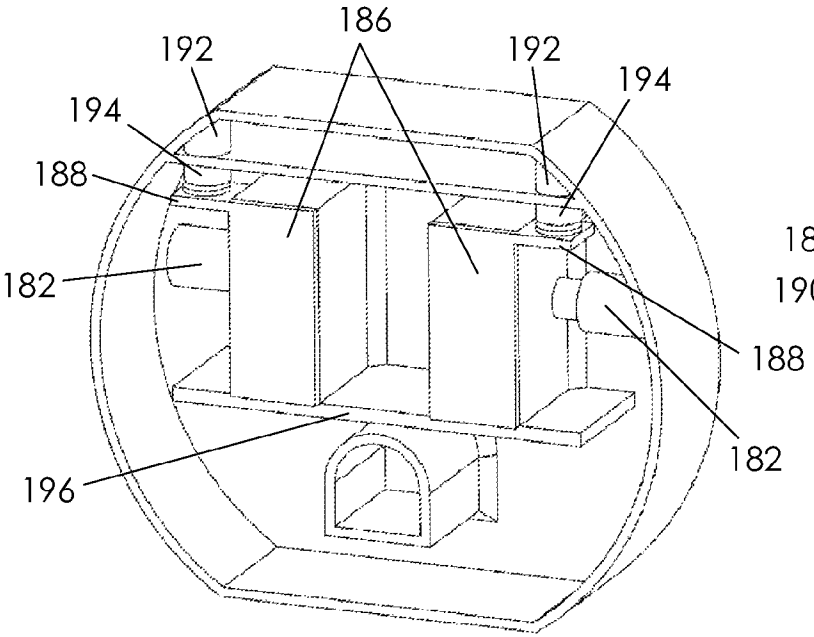
FIG. 25 is a rear perspective view of a fourth aspect tamper resistant shutter system with a first shutter member and a second shutter member in a closed position.
Figure 27:
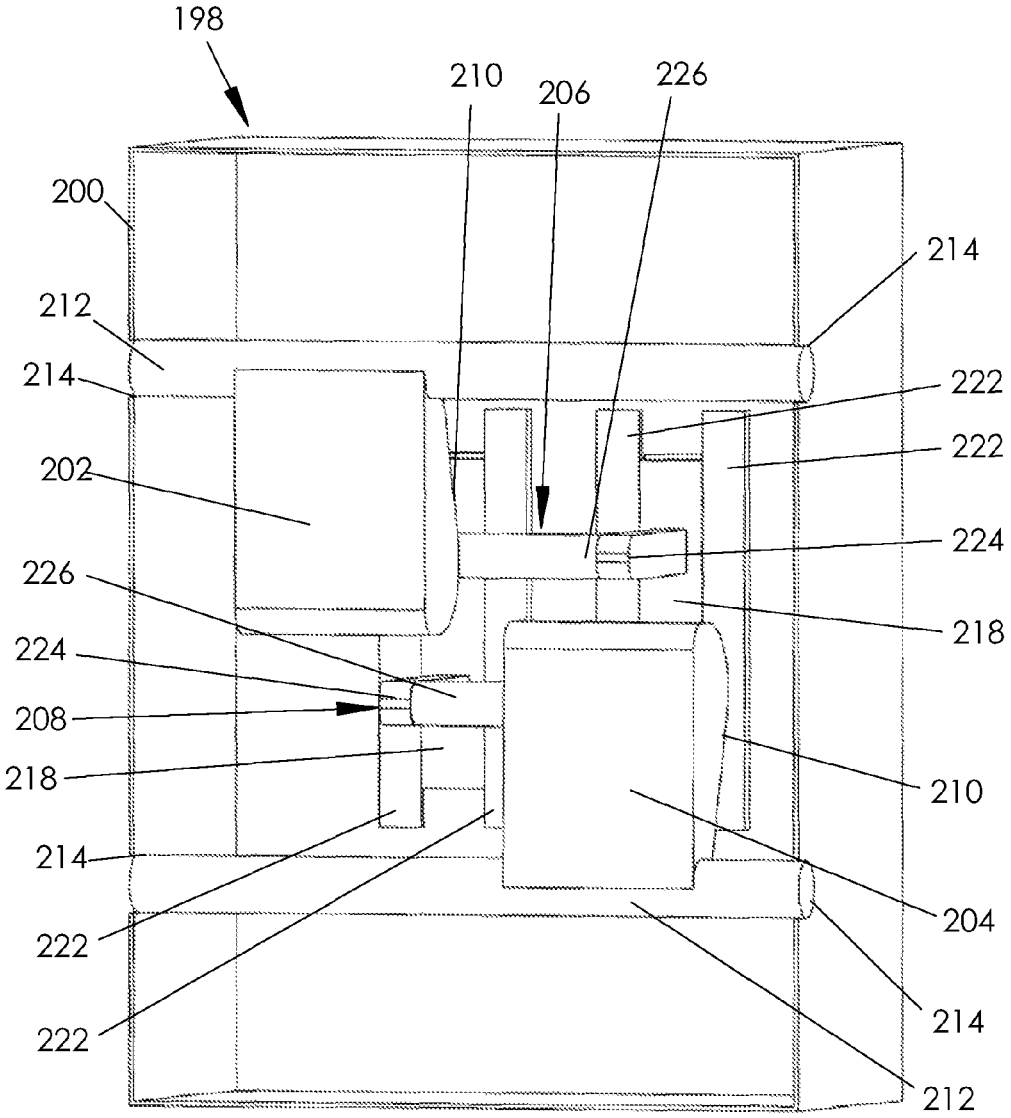
FIG. 27 is a front perspective view of a fifth aspect tamper resistant shutter system in a closed position.
Figure 28:
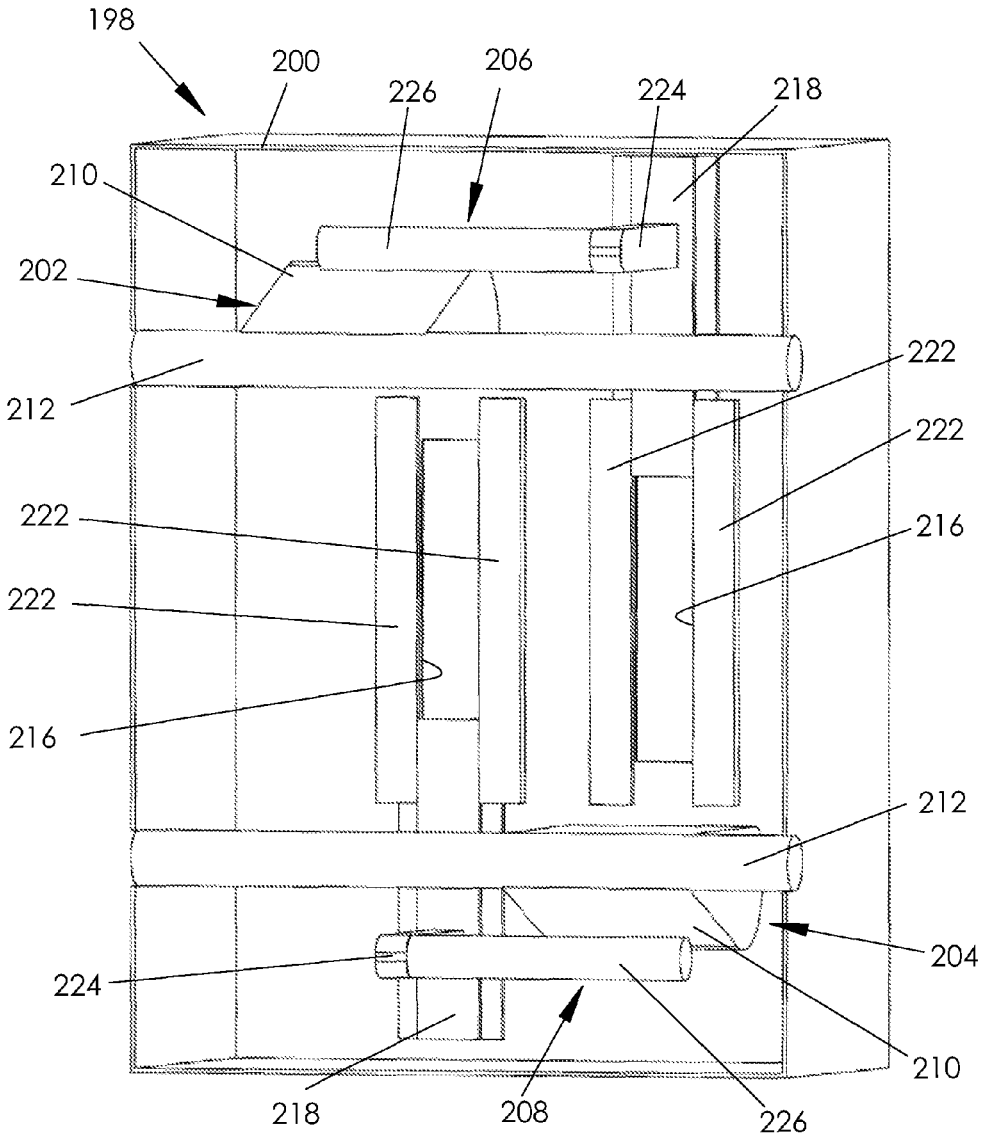
FIG. 28 is a front perspective view of a fifth aspect tamper resistant shutter system in an open position.
Figure 29:
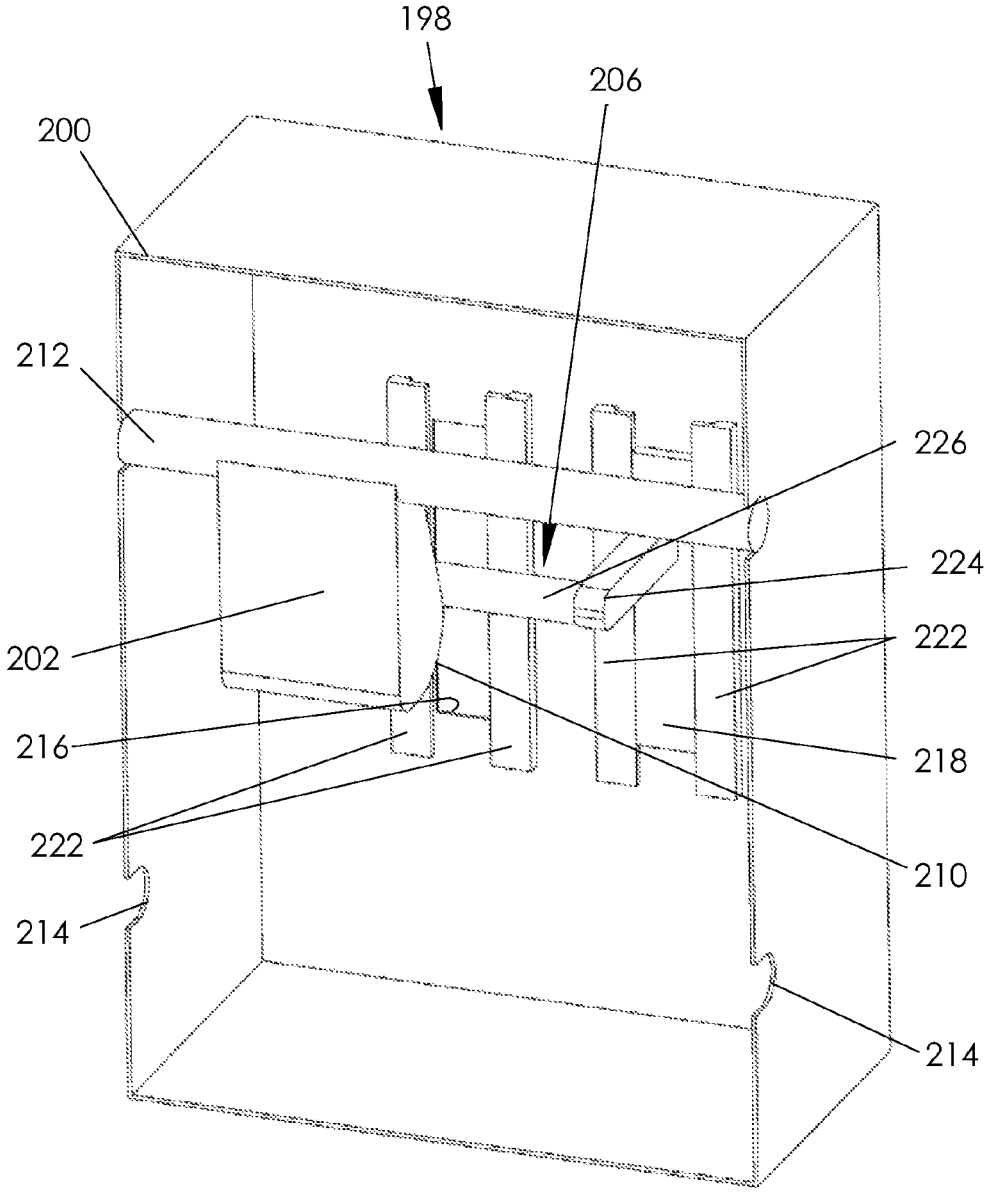
FIG. 29 is a front perspective view of a fifth aspect tamper resistant shutter system with a first shutter member and a third shutter member in a closed position.
Figure 30:
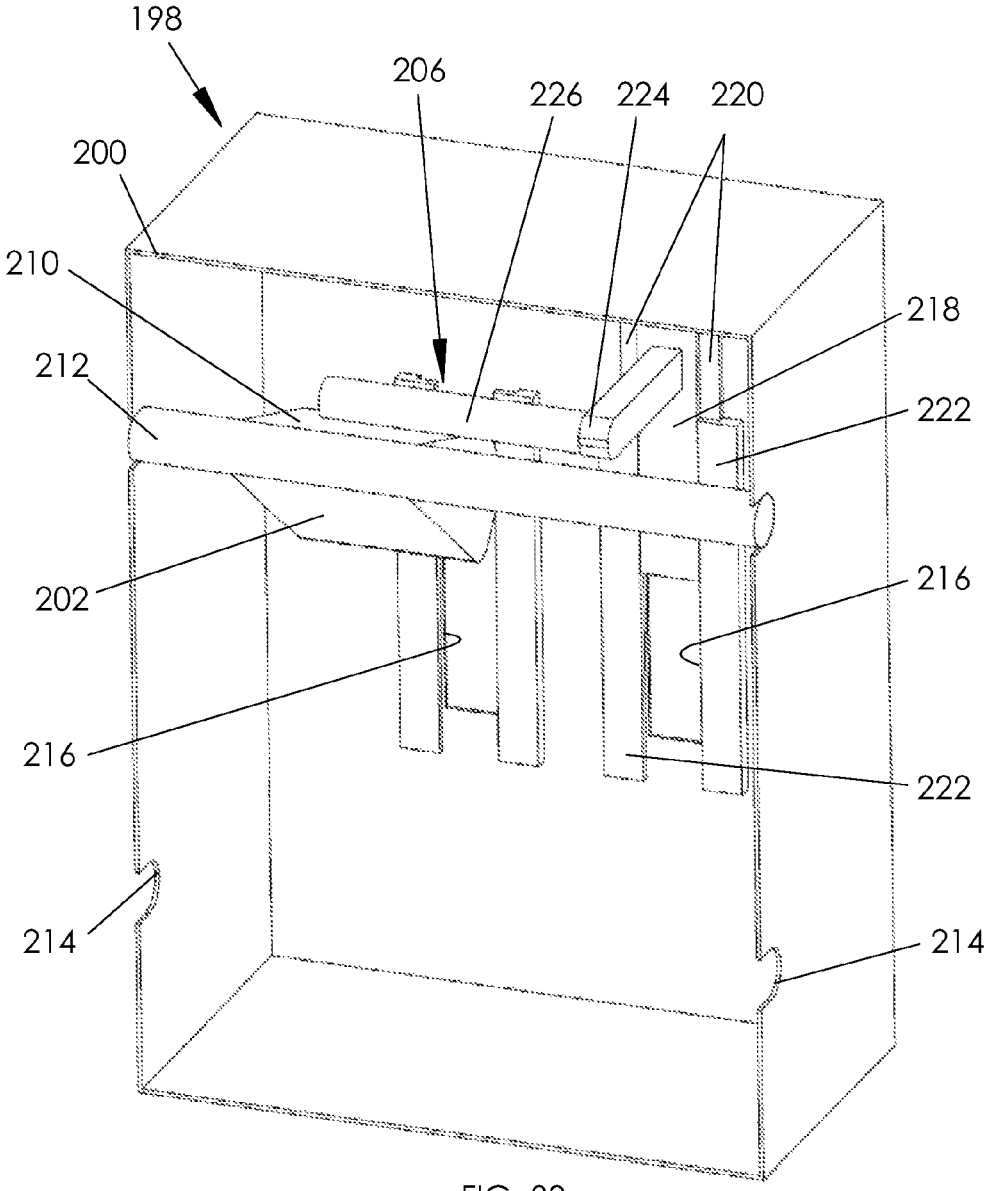
FIG. 30 is a front perspective view of a fifth aspect tamper resistant shutter system with a first shutter member and a third shutter member in an open position.
Figure 31:
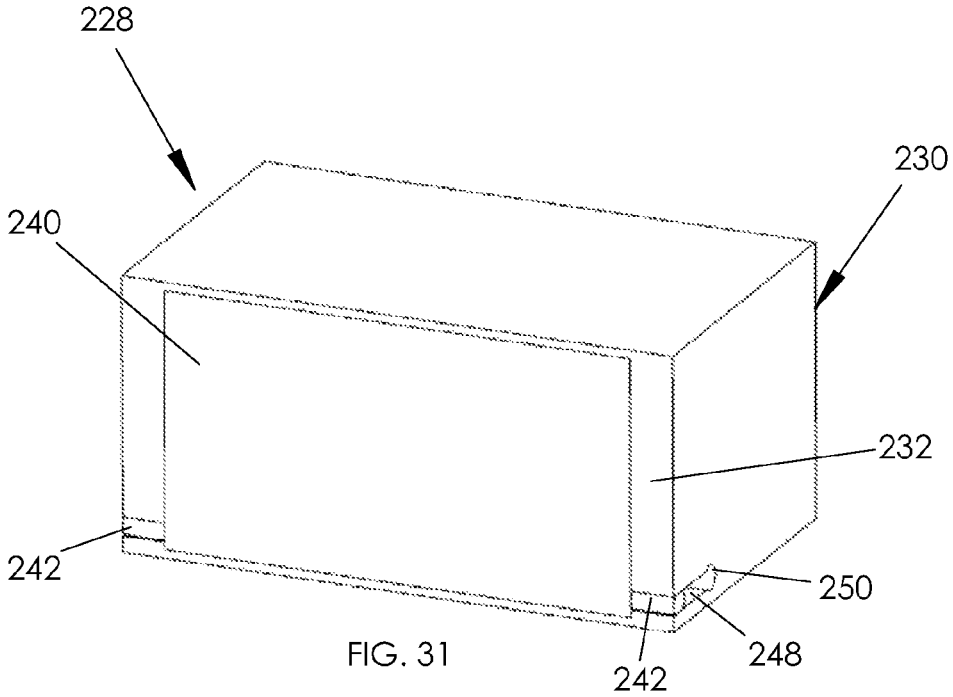
FIG. 31 is a front perspective view of a sixth aspect tamper resistant shutter system with a shutter member in a closed position.
Figure 32:
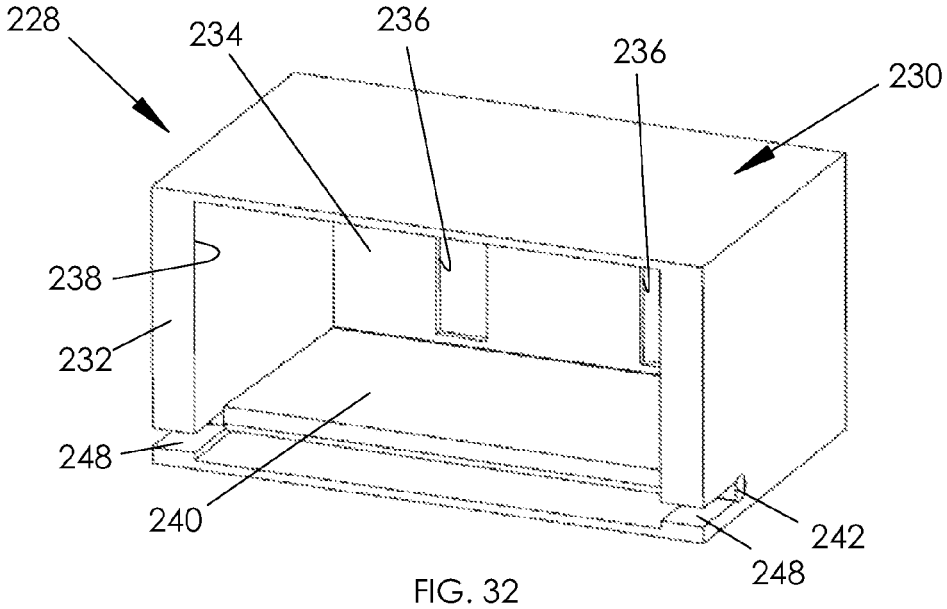
FIG. 32 is a front perspective view of a sixth aspect tamper resistant shutter system with a shutter member slid rearward and rotated to an open position.
Figure 33:
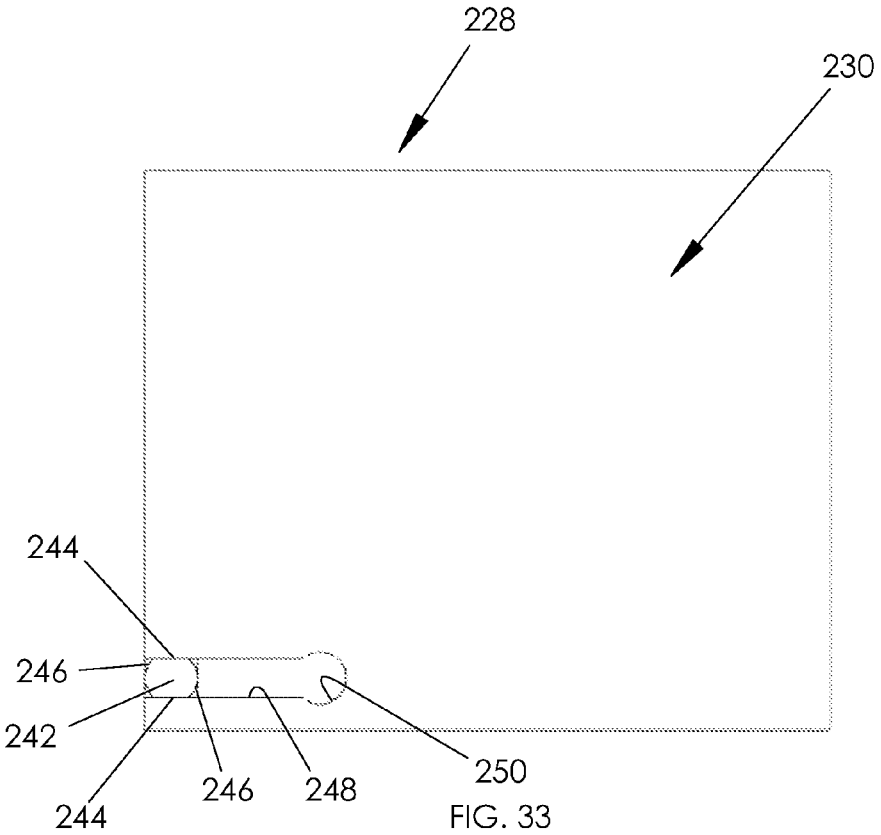
FIG. 33 is a right elevation view of a sixth aspect tamper resistant shutter system with a shutter member in a closed position.
Figure 34:
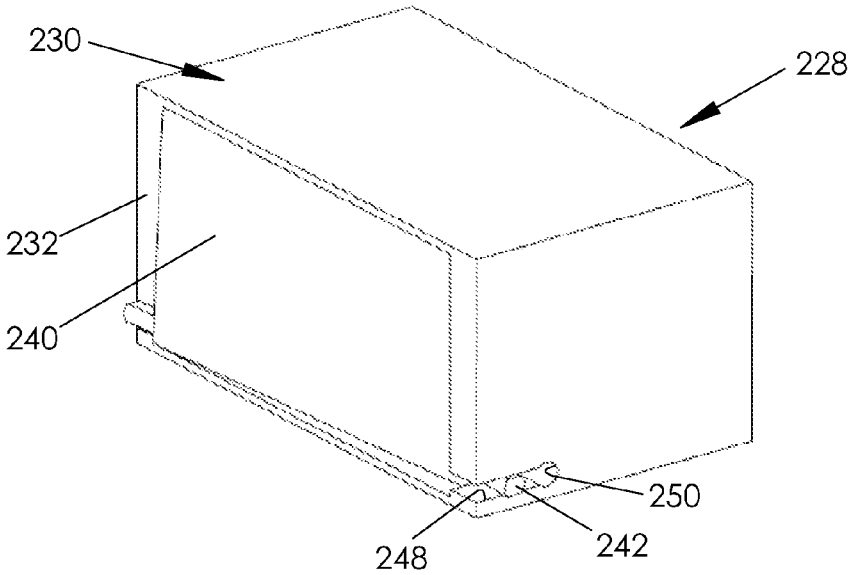
FIG. 34 is a perspective view of a sixth aspect tamper resistant shutter system with a shutter member tilted to one side and preventing the shutter member from moving into an open position.

Still further, a stop ledge 196 may be located below each of housings 176, or even formed integral with housings 176, to limit the distance the shutter members can travel in the opening direction. As illustrated in FIGS. 22, 24, and 26, when shutter members 186 are moved to the open position, mounting rib 188 travels with the shutter member until the mounting rib contacts stop ledge 196 at the open position.

In one aspect, tripping mechanism 182 of one opening 56 may operate to open shutter members 186 of both openings, while in another aspect, each tripping mechanism 182 only operates the shutter member aligned with each tripping mechanism. In still another aspect, the tripping mechanism of one side operates the shutter member of the opposite side. In this arrangement, a user may only reach the electrical contacts when an electrical plug prong is inserted into both openings 56 to the point that both tripping mechanisms 182 are triggered to the open position.

While a photoelectric triggering mechanism is shown and described, any suitable trigger mechanism may be utilized, including but not limited to a limit switch that is compressed during electrical plug blade insertion, a proximity switch, a contact switch, or any other suitable sensing or switching mechanism.

FIGS. 27 through 30 illustrate a fifth aspect tamper resistant shutter system 198. Tamper resistant shutter system 198 is similar to the first aspect tamper resistant system in that rotational movement of the upper shutter members is translated into sliding or linear movement of the lower shutter members. Nevertheless, tamper resistant shutter system 198 is arranged and functions in a different manner.

Tamper resistant shutter system 198 includes a housing 200 with a first shutter member 202, a second shutter member 204, a third shutter member 206, and a fourth shutter member 208. First shutter member 202 may be engaged with third shutter member 206, while second shutter member 204 may be engaged with fourth shutter member 208. The first and second shutter members may include an angled contact surface 210 arranged to contact the third or fourth shutter member, respectively. The first and second shutter members also include a mounting rod 212 which are rotatably secured within grooves 214 of housing 200. Mounting rods 212 are preferably offset from apertures 216 so that the first and second shutter members can pivot without interference.

Third and fourth shutter members 206 and 208 each include a blocking sheet 218 with recessed edges 220 arranged to be secured between aperture guards 222. Aperture guards 222 assist in locating blocking sheet 218 during operation and may function as a track or guide for blocking sheet movement. The third and fourth shutter members each include a spacing arm 224 extending away from a back surface of blocking sheet 218. Further, a sliding arm 226 is mounted to spacing arm 224 in a generally perpendicular orientation and arranged behind the respective first and second shutter members. Specifically, sliding arm 226 of the fourth shutter member is located behind the first shutter member, while the sliding arm 226 of the third shutter member is located behind the second shutter member. Accordingly, this arrangement again ensures that inserting an object in one of the electrical device openings does not fully open the electrical device to engage the electrical contacts unless an object is inserted into both of the electrical device openings.

The operation of tamper resistant shutter system 198 is similar to the first aspect tamper resistant shutter system, in that the first and second shutter members are rotated to the open position and thereby slide the respective third and fourth shutter members to the open position. Nevertheless, the operation is different in that the shutter members rotate in a direction 180 degrees from those of the first aspect. Specifically, the first and second shutter members pivot in a direction about the shortest length of apertures 216 in a direction generally opposite one another. However, it is within the spirit and scope of the disclosure for the first and second shutter members to pivot in the same direction. When the first and second shutter member rotate, they each contact the respective sliding arm 226, which in turn forces blocking sheet 218 out of aperture 216 to permit the electrical plug blade to pass through the opening. The mounting rods 212 or the lower shutter members may also be spring biased to the closed position to automatically return the shutter members to the closed position after the electrical plugs are removed.

FIGS. 31 through 34 illustrate a sixth aspect tamper resistant shutter system 228. Tamper resistant shutter system 228 includes a housing 230 having a front wall 232 arranged to be located behind and adjacent an electrical device face and a rear wall 234 having a pair of apertures 236. Apertures 236 are aligned with openings 56 in the device face 42 and electrical contacts are positioned behind apertures 236. A cavity 238 may be formed in housing 230 and specifically front wall 232. Cavity 238 is selectively covered by a shutter member 240 having a pair of rods 242. Each rod 242 extends from a bottom edge of shutter member 240 and may include a flat top and bottom walls 244 and arcuate side walls 246.

Housing 230 includes a pair of slots 248 and pivot apertures 250 extending through front wall 232 towards rear wall 234 and in communication with cavity 238. Slots 248 are generally rectangular in shape and extend a predetermined distance until reaching pivot apertures 250 which may be wider than slots 248. Slots 248 extend long enough so that if a user attempts to insert an object into only one opening 56 of the electrical device, one side of the shutter member is forced backwards into pivot aperture 250. While the side of the shutter member has been pushed back into position within pivot aperture 250 for rotational movement, with the other side still within slot 248, the shutter member is incapable of rotating to the open position and providing access to the electrical contacts.

During normal operation, both electrical plug blades contact shutter member 240 virtually simultaneously, thereby sliding shutter member 240 rearward until rods 242 are located within pivot apertures 250. Shutter member 240 slides rearward because rods 242 include the flat top and bottom walls 244 which are complimentary shaped and sized to slot 248, thereby permitting only sliding movement when rod 242 is within slot 248. Once rods 242 are within pivot aperture 250, arcuate side walls 246 mate with pivot aperture 250 to provide rotational movement, but only if both rods 242 are located within pivot apertures 250. A spring (not shown) may be located behind shutter member 240 to bias the shutter member in the closed position, while a stop (also not shown) may be used to limit the shutter member travel in the closing direction, or the back of device face 42 may be utilized as a stop.

Thus, it is seen that tamper resistant shutter system 228 advantageously restricts access to the electrical contacts unless an electrical plug blade simultaneously contacts shutter member 240 during the full length of slot 248 during plug blade insertion.

FIGS. 35 through 38 illustrate a seventh aspect tamper resistant shutter assembly 252. Tamper resistant shutter assembly 252 includes a housing 254 with a first shutter member 256, a second shutter member 258, a third shutter member 260, and a fourth shutter member 262. The seventh aspect tamper resistant shutter assembly is similar to the first aspect shutter assembly in that the first and second shutter members 256 and 258 pivot to the open position and slide the third and fourth shutter members 260 and 262 to the open position. Once again, springs 264 bias third and fourth shutter members 260 and 262 to the closed position. Nevertheless, tamper resistant shutter assembly 252 operates with first and second shutter members 256 and 258 pivoting in the direction of the electrical plug insertion, but in directions generally opposite one another and pivoting about the longest side of openings 266 in housing 254. In the same manner, third and fourth shutter members 260 and 262 each slide to the open position in directions generally towards one another.

Figure 35:
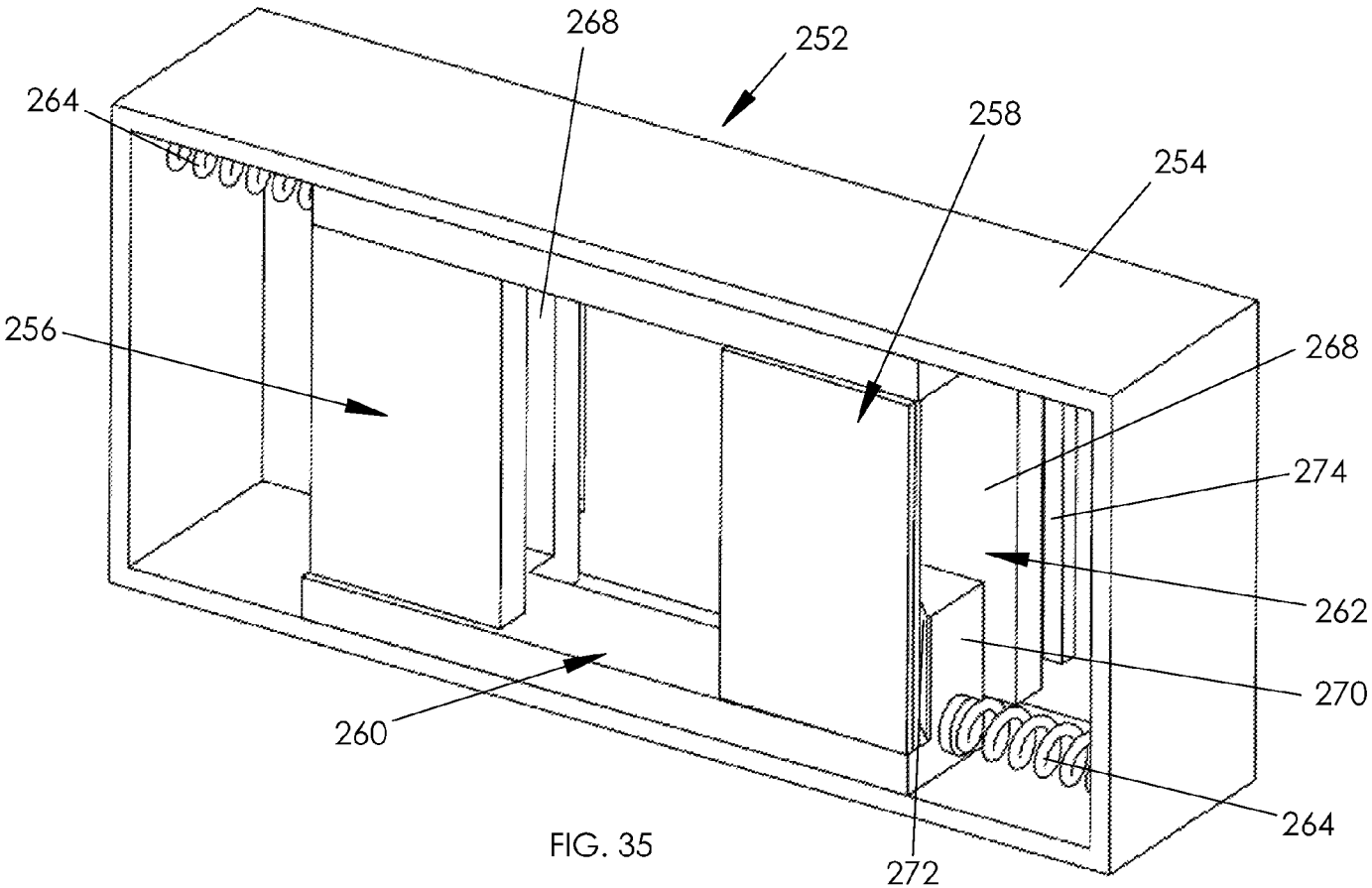
FIG. 35 is a perspective view of a seventh aspect tamper resistant shutter system in a closed position.
Figure 36:
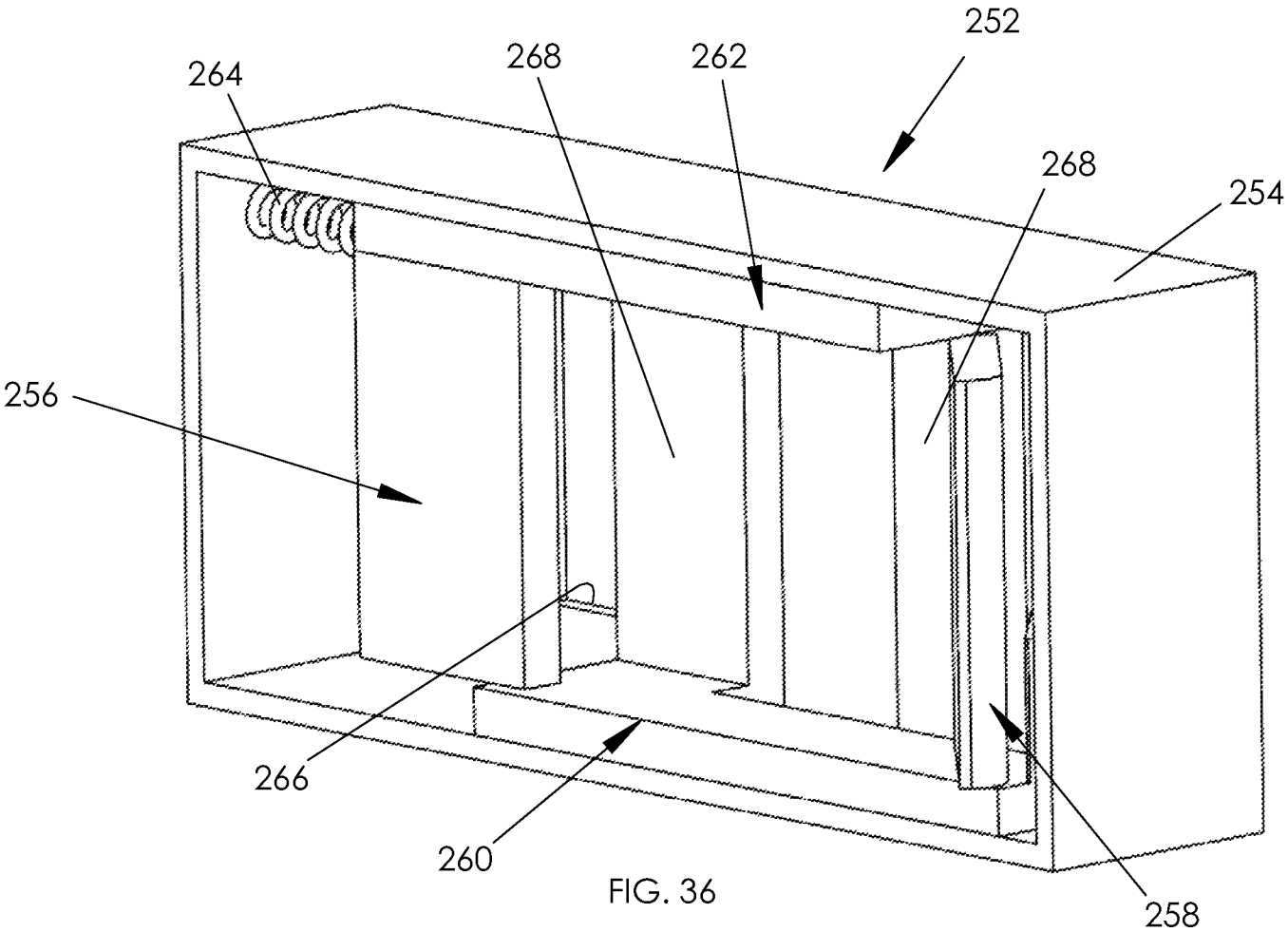
FIG. 36 is a perspective view of a seventh aspect tamper resistant shutter system with a second shutter member and a third shutter member in an open position.
Figure 37:
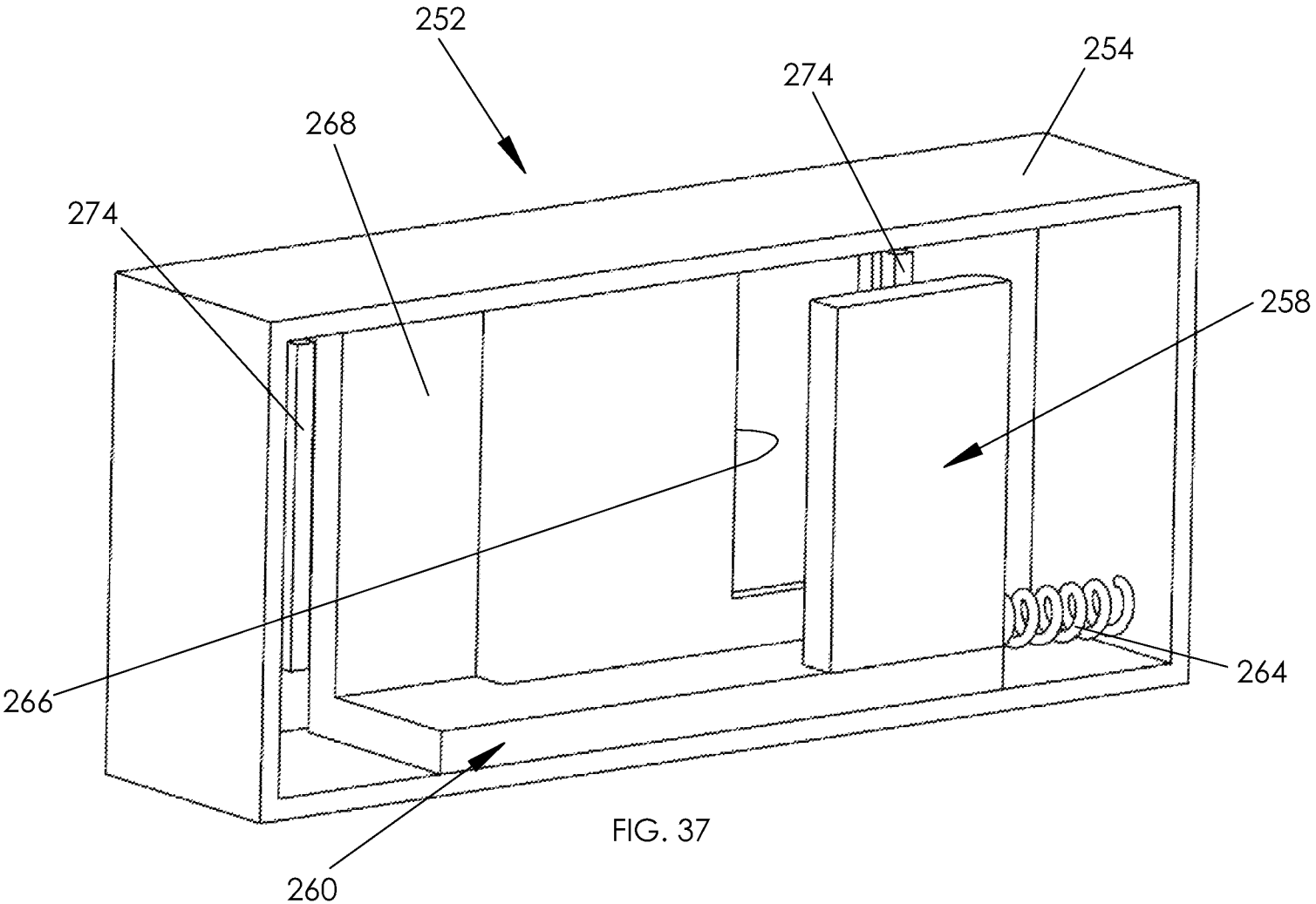
FIG. 37 is a perspective view of a seventh aspect tamper resistant shutter system with a second shutter member and a third shutter member in a closed position.
Figure 38:
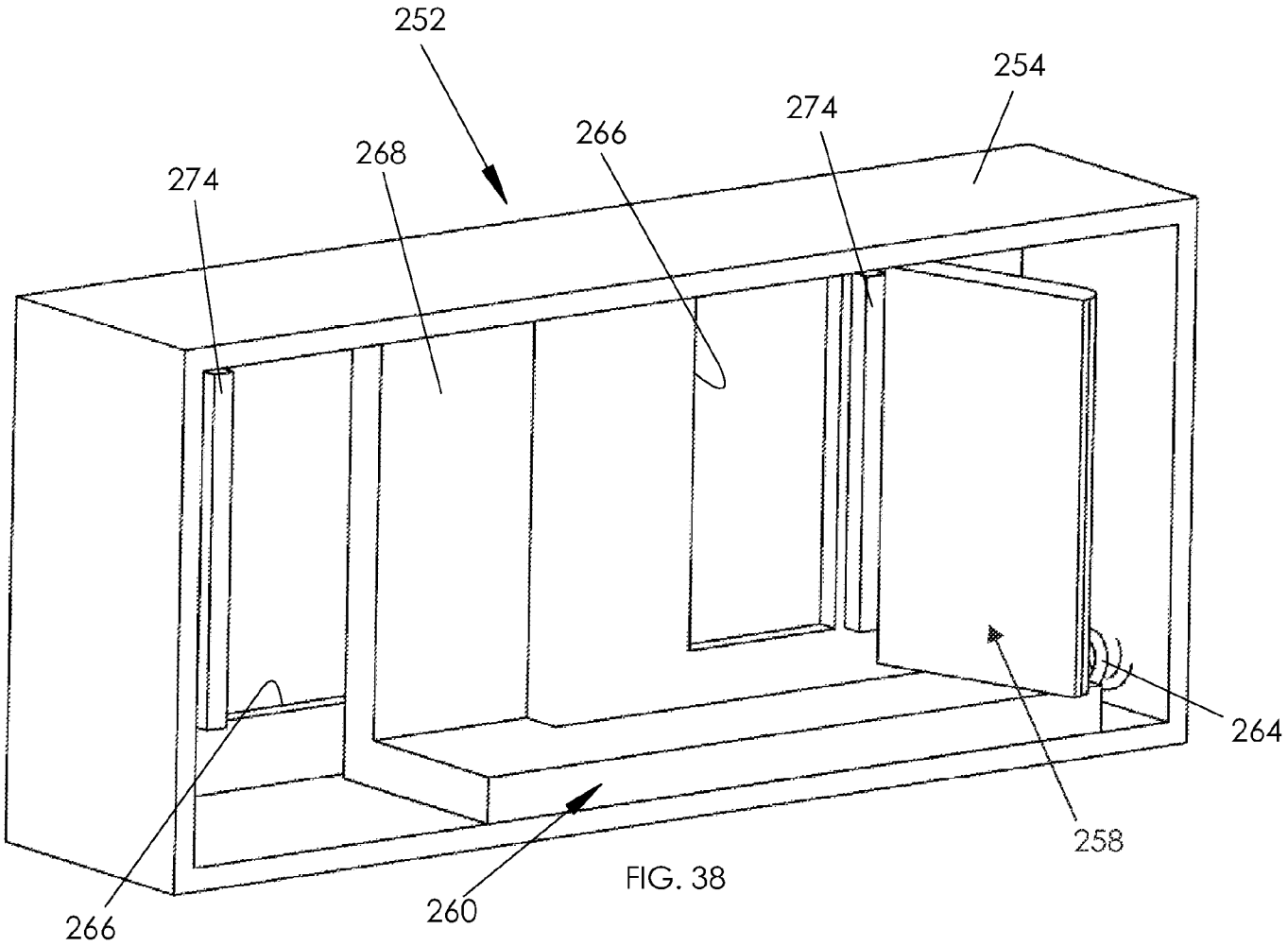
FIG. 38 is a perspective view of a seventh aspect tamper resistant shutter system with a second shutter member and a third shutter member in an open position.
Figure 39:
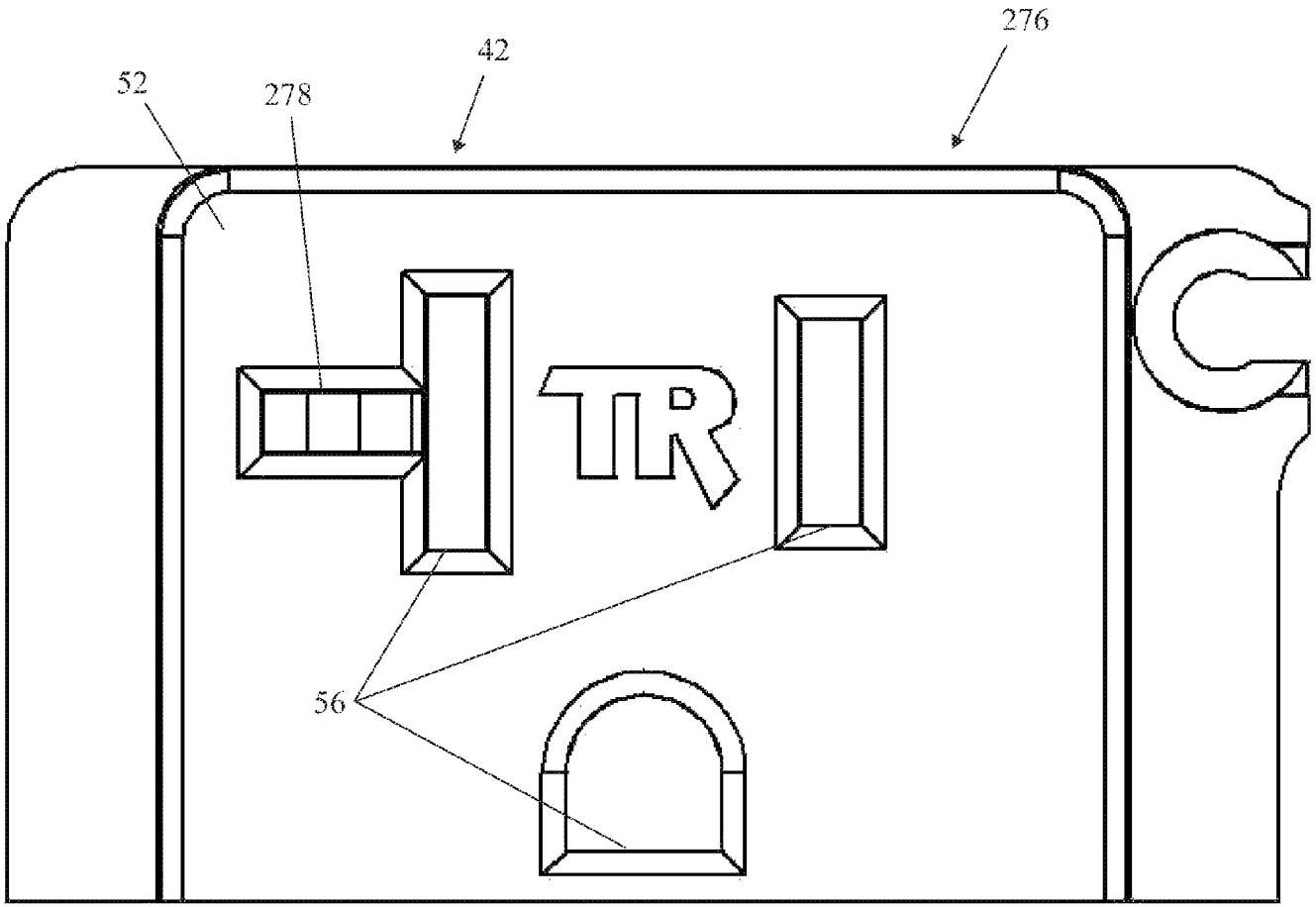
FIG. 39 is a partial front view of a 20 amp tamper resistant electrical face with an eighth aspect tamper resistant shutter system in the closed position.
Figure 40:
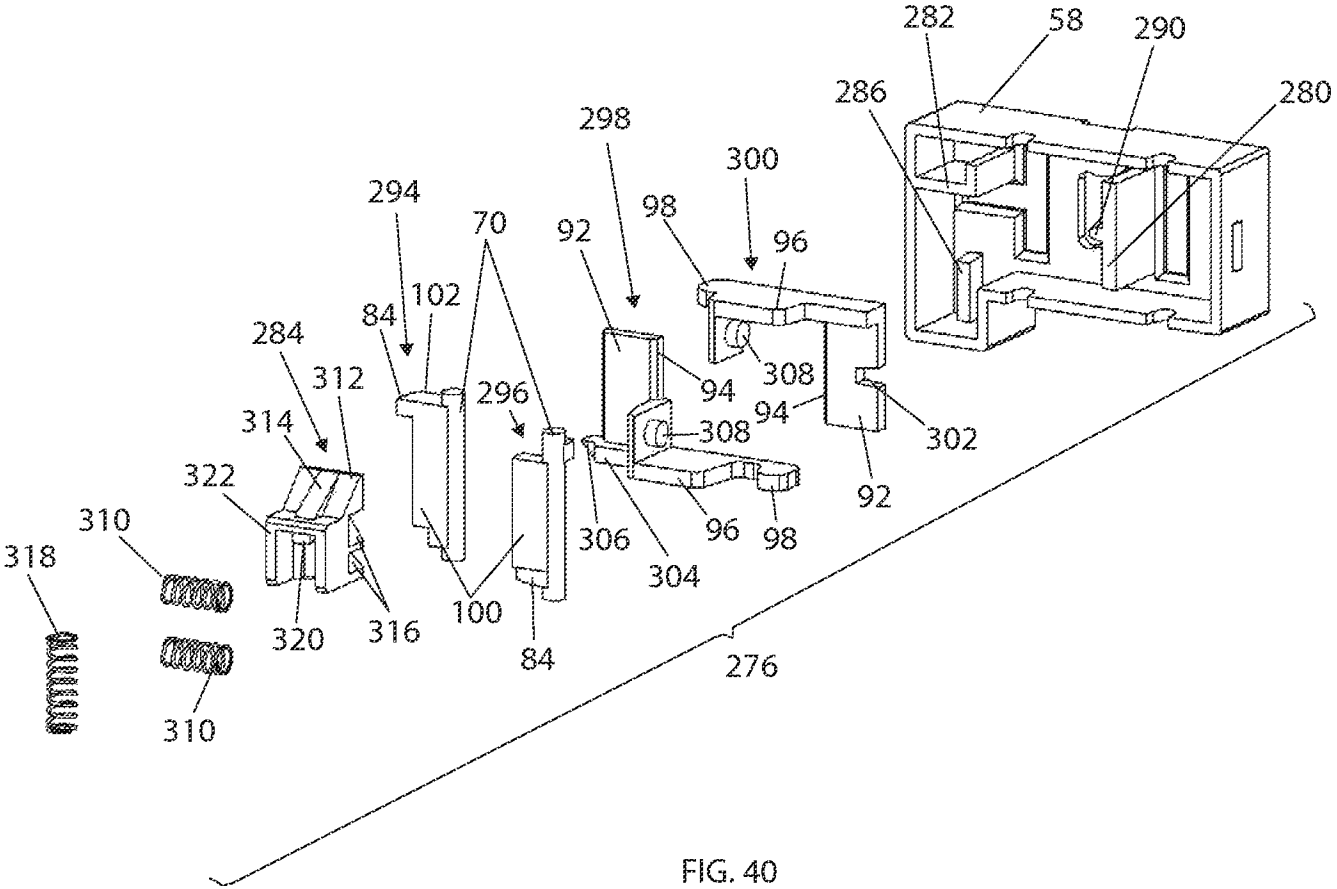
FIG. 40 is an exploded view of the eighth aspect tamper resistant shutter system.
Figure 41:
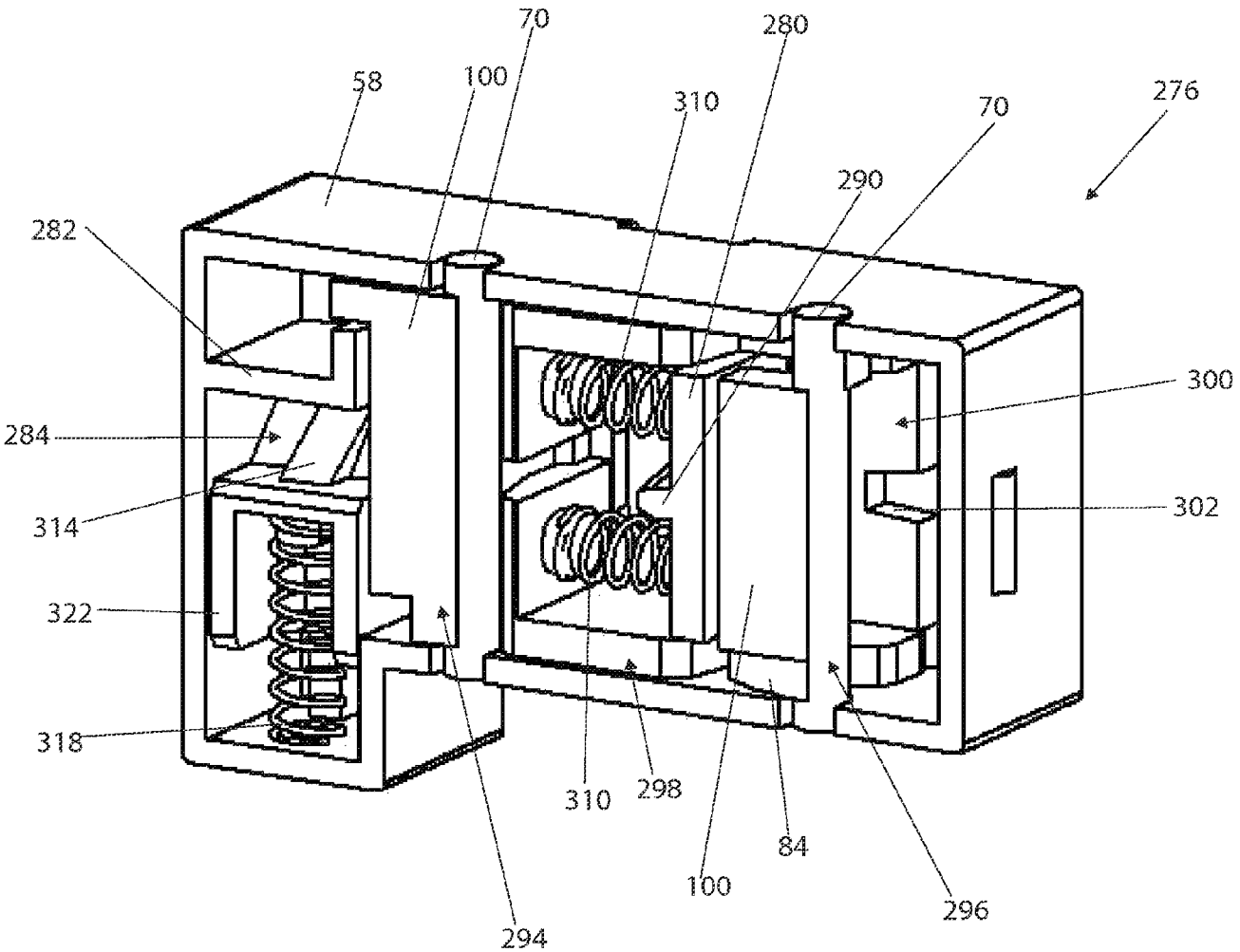
FIG. 41 is an assembled front perspective view of the eighth aspect tamper resistant shutter system in the closed position.
Figure 42:
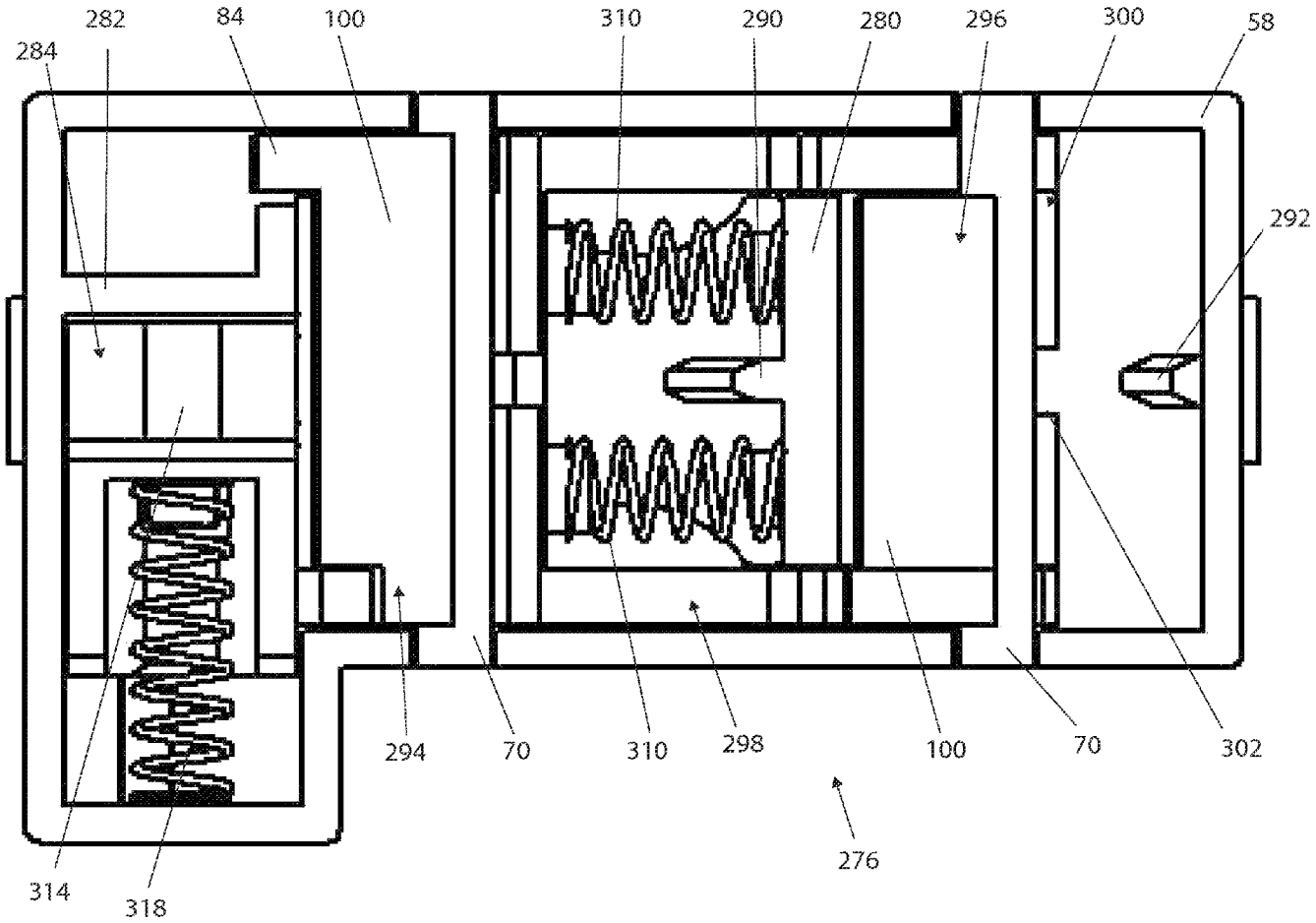
FIG. 42 is a front view of the eighth aspect tamper resistant shutter system in the closed position.
Figure 43:
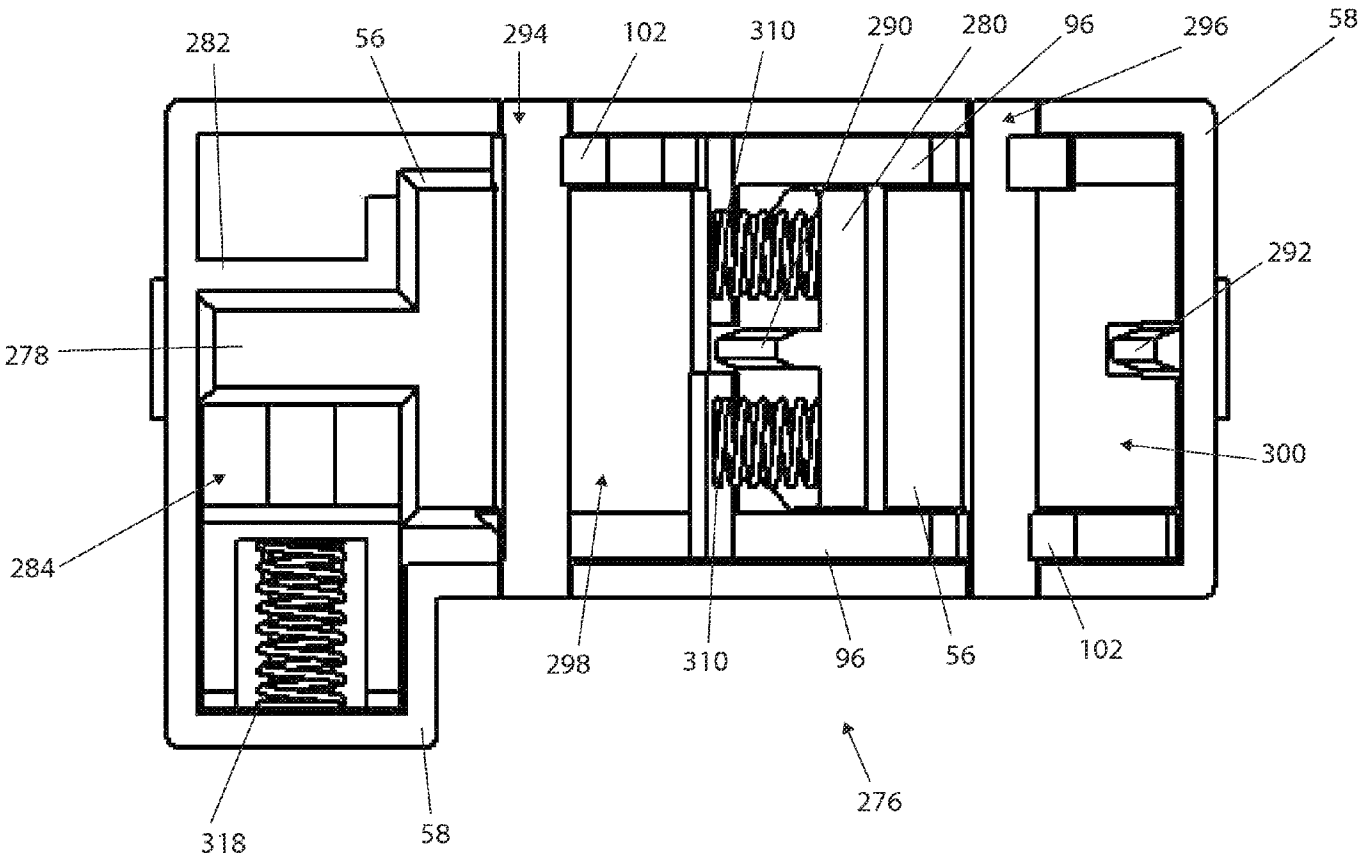
FIG. 43 is a front view of the eighth aspect tamper resistant shutter system in the open position.
Figure 44:
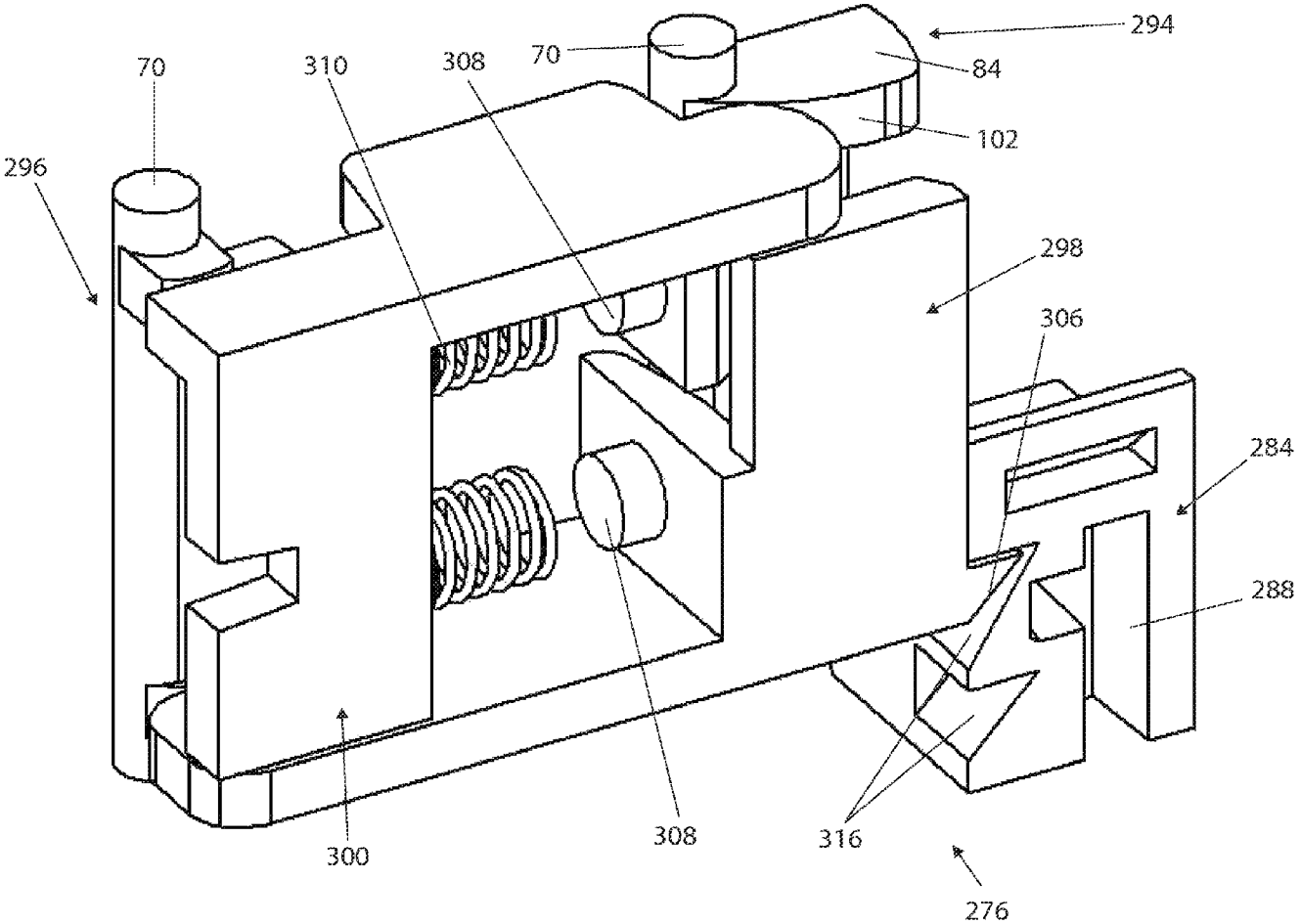
FIG. 44 is a perspective view of components of the eighth aspect tamper resistant shutter system and the locking mechanism of a perpendicular prong shutter in the closed position.
Figure 45:
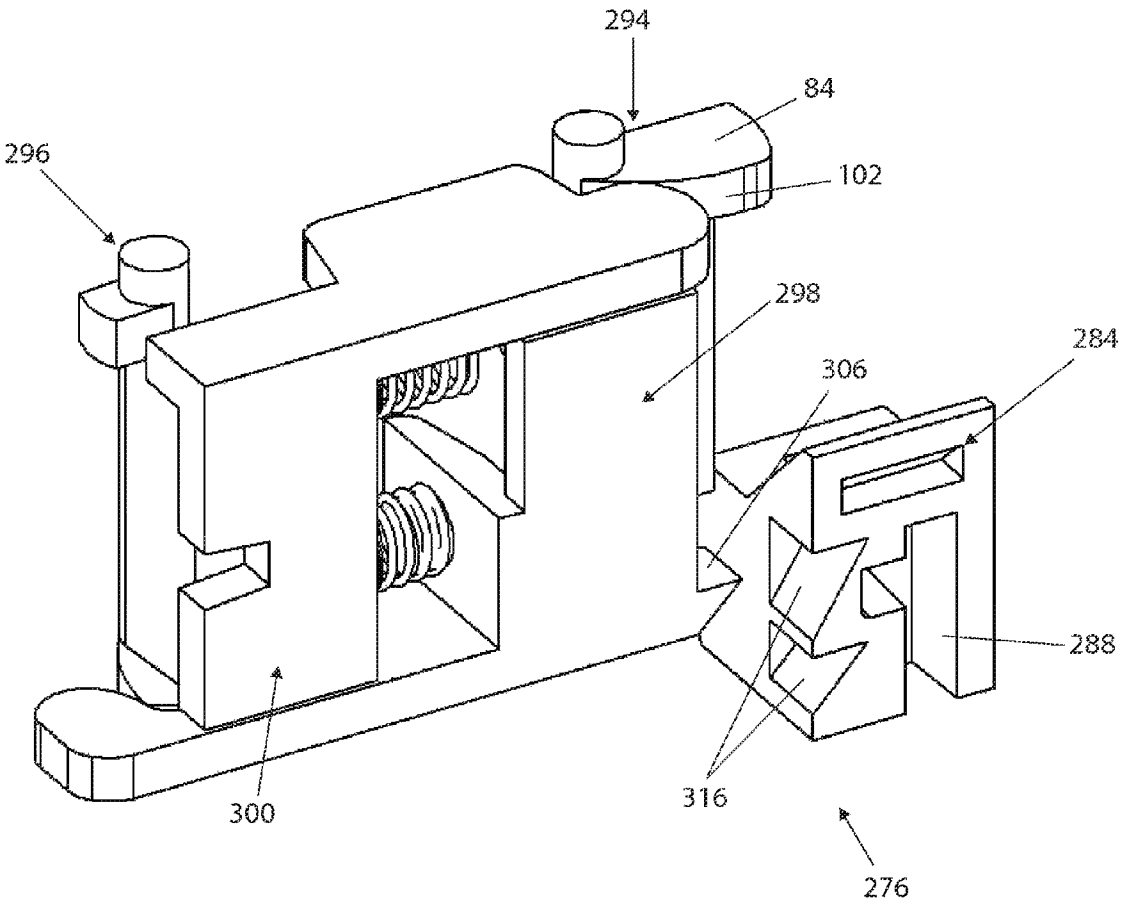
FIG. 45 is a perspective view of components of the eighth aspect tamper resistant shutter system and the locking mechanism of a perpendicular prong shutter in the open position.

Referring to FIG. 35, both third and fourth shutter members 260 and 262 include a blocking surface 268 with a transfer portion 270 having an angled surface 272 arranged to engage with the respective upper shutter member (256 or 258) during operation. Angled surface 272 is arranged to permit first and second shutter members 256 and 258 to pivot or rotate enough to clear the path of the electrical plug blades before contacting the transfer portion in one implementation. After the first and second shutter members have pivoted into contact with angled surface 272 of transfer portion 270, the first and second shutter members continue to rotate, thereby sliding the third and fourth shutter members linearly and moving blocking surfaces 268 towards one another to allow the electrical plug blades to extend through openings 266.

After the electrical plug blades are removed from the electrical device and the tamper resistant shutter assembly, springs 264 are biased to slide the respective lower shutter members (260 and 262) into the closed position and both transfer portion 270 and angled surface 272 interact with upper shutter member 256 and 258 to pivot or rotate the upper shutter members to the closed position. A stop 274 is utilized adjacent openings 266 and extends from the base of housing 254 to limit the travel of the third and fourth shutter members, respectively, in the closing direction.

Further, the operation of tamper resistant shutter system 252 is also similar to the first aspect tamper resistant shutter system in that the first shutter member pivotally or rotationally contacts the fourth shutter member for linear movement, while the second shutter member pivotally or rotationally contacts the third shutter member for linear movement.

FIGS. 39 through 45 illustrate an eighth aspect tamper resistant shutter system 276 with a device face 42 having a front surface 52, openings 56, and a perpendicular prong opening 278. System 276 includes a housing 58 with a first stop wall 280 limiting travel of the shutters and a second stop 282 generally perpendicular to the first stop to limit the travel of a perpendicular prong shutter 284. The housing may also include a perpendicular prong shutter guide 286 extending from the shutter and arranged to mate with a slot 288 in the perpendicular prong shutter 284, while a first divider 290 may extend from first stop 280 to separate the springs and a second divider 292 may extend inward from housing 58 to assist in locating a lower shutter during operation (described in greater detail below).

Similar to many of the previously disclosed tamper resistant shutter systems, the eighth aspect shutter system includes four shutter members, with a first shutter member 294 and a second shutter member 296 acting as upper shutter members and a third shutter member 298 and a fourth shutter member 300 acting as lower shutter members. Once again, the first and second shutter members pivot from the closed position to the open position about pivot shoulders 70. However, unlike some of the previous aspects, the upper shutter members may pivot in the same direction and push/pull the lower shutter members in the same direction. Nevertheless, the same concept is utilized where the upper shutter member of one side operates the lower shutter on the opposite side. Further, both upper shutter members include blocking surface 100, finger 84, and rounded engagement portion 102.

The lower shutter members each include blocking ledge 92 with tapered end 94, guide 96, and arm 98 which is arranged to contact the respective upper shutter member during opening and closing. Fourth shutter member 300 may also include an alignment notch 302 arranged to align with second divider 292 during operation. Further, third shutter member 298 may include a locking arm 304 with a locking ledge 306 which interacts with perpendicular prong shutter 284 as will be discussed in greater detail below. Finally, both the lower shutter members include spring mounts 308 arranged to hold a spring 310 and bias the lower shutter members into the closed position and thereby also bias the upper shutter members into the closed position.

The operation of the upper and lower shutter members is similar to previous aspects disclosed herein and the upper shutter members pivot in the same direction to slide the lower shutter members.

Shutter system 276 also includes perpendicular shutter 284 to limit access to the electrical contacts while still permitting a 20 amp electrical plug to be inserted within the device. Perpendicular shutter member 284 includes a sloped outer surface 312 with a raised contact surface 314. The combination of the two surfaces 312 and 314 permits the perpendicular shutter member to be located below the contact surface of blocking ledge blocking surface 100 of the upper shutter members. Accordingly, the upper shutter members are contacted and partially rotate, thereby sliding the respective lower shutter members prior to the electrical plug contacting the perpendicular shutter member 284. When the lower shutter members slide open, locking ledge 306 is pulled out of locking aperture 316 of perpendicular shutter member 284 to permit the perpendicular shutter member to move to the open position.

Specifically, perpendicular shutter member 284 is biased to the closed position with a spring 318 mounted between a spring tab 320 on a rear portion 322 and housing 58. Locking apertures 316 permit the perpendicular shutter member to travel upward when contacting locking ledge 306, while resisting downward movement (or movement in the opening direction). Thus, perpendicular shutter member 284 can be moved to the closed position by spring 318 at any time against locking ledge 306, but cannot be moved to the open position unless the locking ledge is removed from locking aperture 316. As can be seen in the FIGS and description, the operation is similar to previous aspects, the additional step of clearing the perpendicular shutter member may occur before, after, or during the upper and lower shutter member movement without departing from the spirit and scope of the disclosure.

Figure 46:
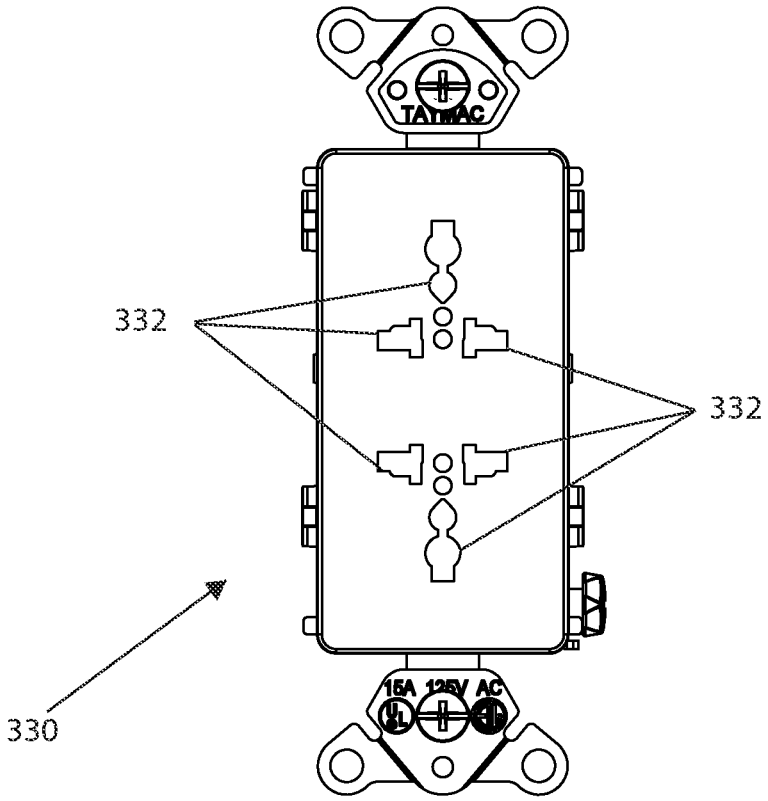
FIG. 46 is a front view of an electrical device with Chinese electrical socket opening.

FIG. 46 illustrates a Chinese electrical device 330 incorporating any of the above-referenced tamper resistant shutter systems. Electrical device 330 also includes a plurality of apertures 332 of various shapes, sizes, and orientations to receive the correct electrical plug. While the aperture shape, size, and orientation may vary, the tamper resistant system components and operation remains the same as any of the above disclosed aspects. Thus, it is seen that the tamper resistant shutter system may be incorporated to work with any number of electrical plugs and various types of plug arrangements.

Figure 47:
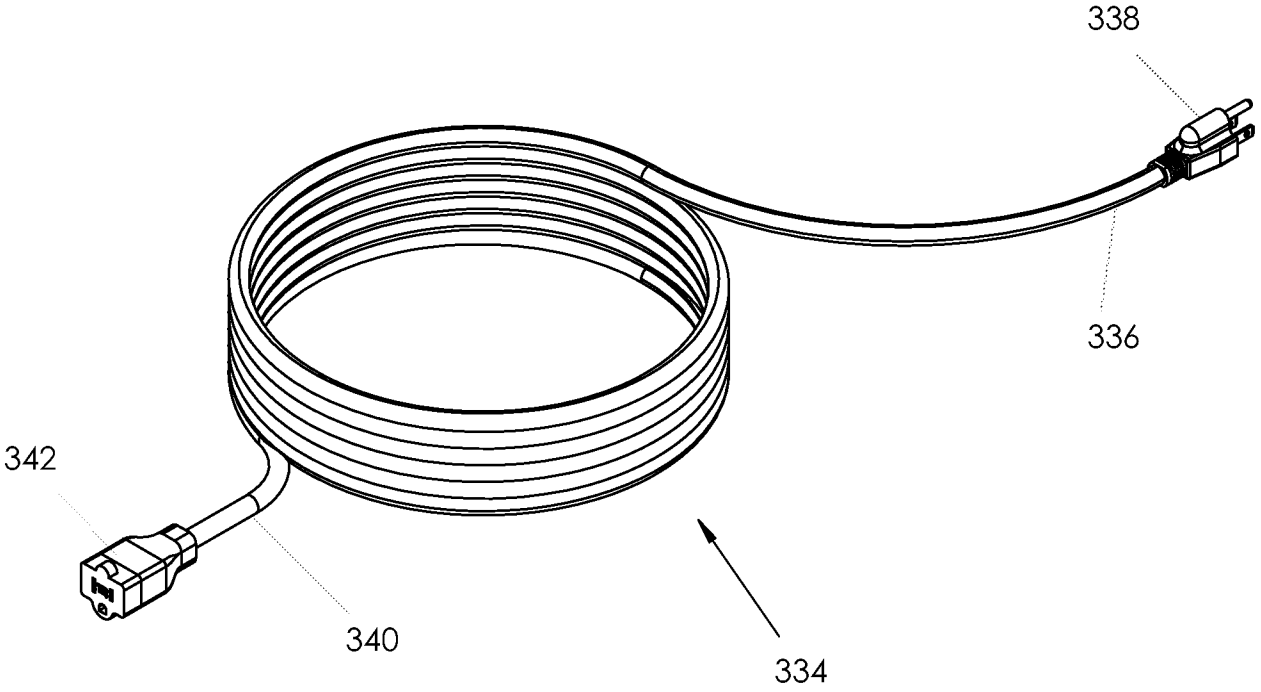
FIG. 47 is a perspective view of an electrical extension cord with a tamper resistant shutter system therein.
Figure 48:
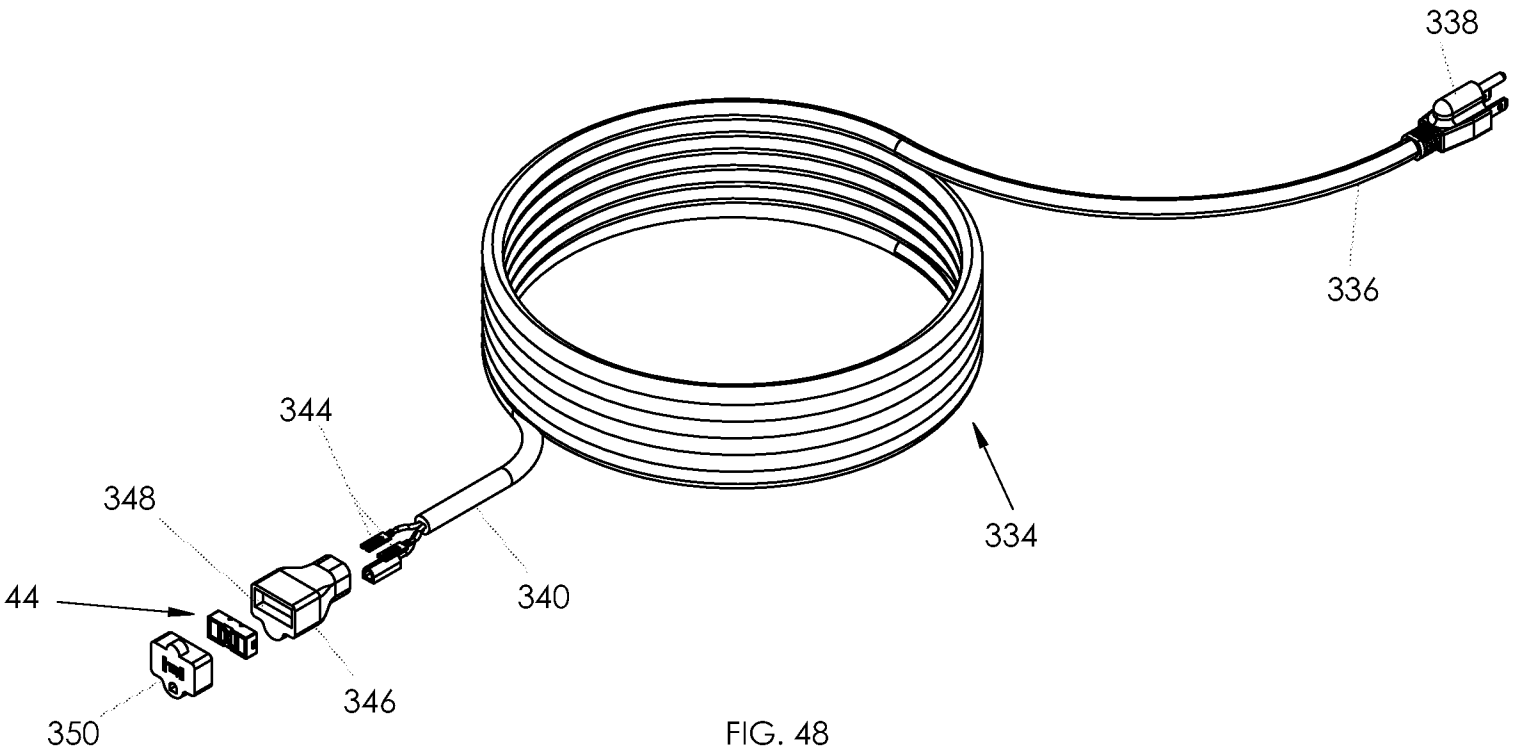
FIG. 48 is a partially exploded perspective view of the electrical extension cord in FIG. 47.

FIGS. 47 and 48 illustrate an extension cord 334 having a first end 336 with a plug 338 thereon and a second end 340 opposite the first end and having a receptacle 342. Second end 340 includes tamper resistant shutter system 44 located within second end housing 346 and specifically second end housing opening 348. Further, electrical contacts 344 are disposed within second end housing 346 and arranged to receive an electrical plug and provide electrical current. A faceplate 350 may be integrally formed with second end housing 346 or removeably secured to the second end housing and is arranged to secure the tamper resistant shutter system 44. As discussed above, the tamper resistant shutter system 44 functions identical to the similarly numbered embodiment above, or any other tamper resistant shutter discussed herein in relation to other embodiments.

Figure 49:
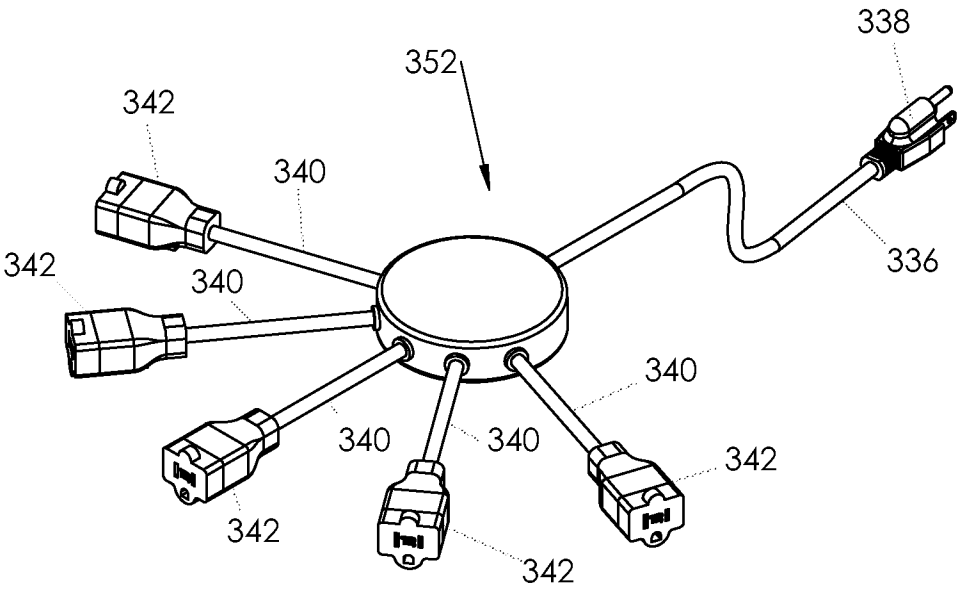
FIG. 49 is a perspective view of a multiple outlet squid style electrical extension cord having a tamper resistant shutter system therein.
Figure 50:
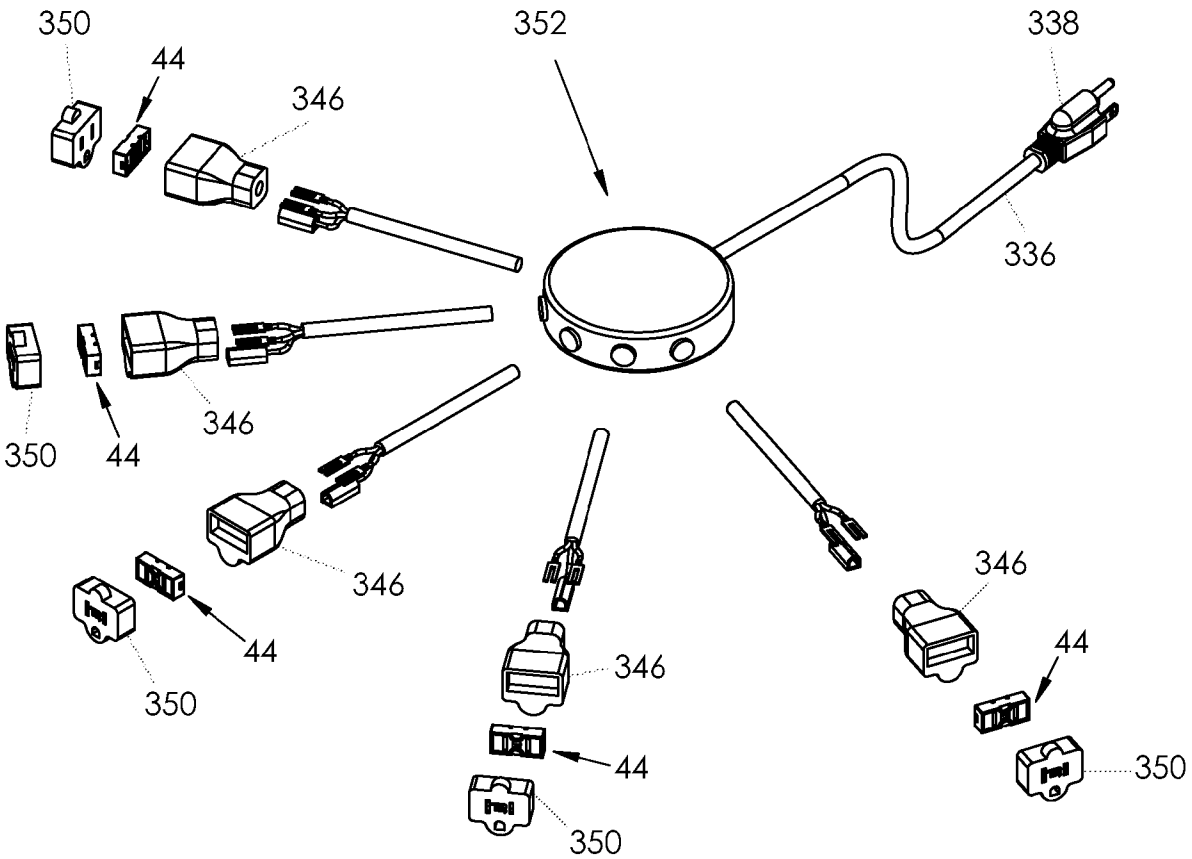
FIG. 50 is a partially exploded perspective view of a multiple outlet squid style electrical extension cord having a tamper resistant shutter system therein.

Referring now to FIGS. 49 and 50, a power tap style device 352 is illustrated having first end 336 with plug 448 and a plurality of second ends 340, each second end 340 having a receptacle 342 thereon. As discussed with reference to FIGS. 47 and 48, the power tap 352 includes a plurality of second end housing 346, each having a tamper resistant shutter system 44 (as discussed above) therein. Further, faceplates 350 may be integral with second end housing 346 or a removable component. Regardless, faceplates 350 each provide an outer boundary for the tamper resistant shutter system and prevent dislocation of the tamper resistant shutter system. This embodiment will also work with any other tamper resistant shutter discussed herein in relation to other embodiments.

Figure 51:
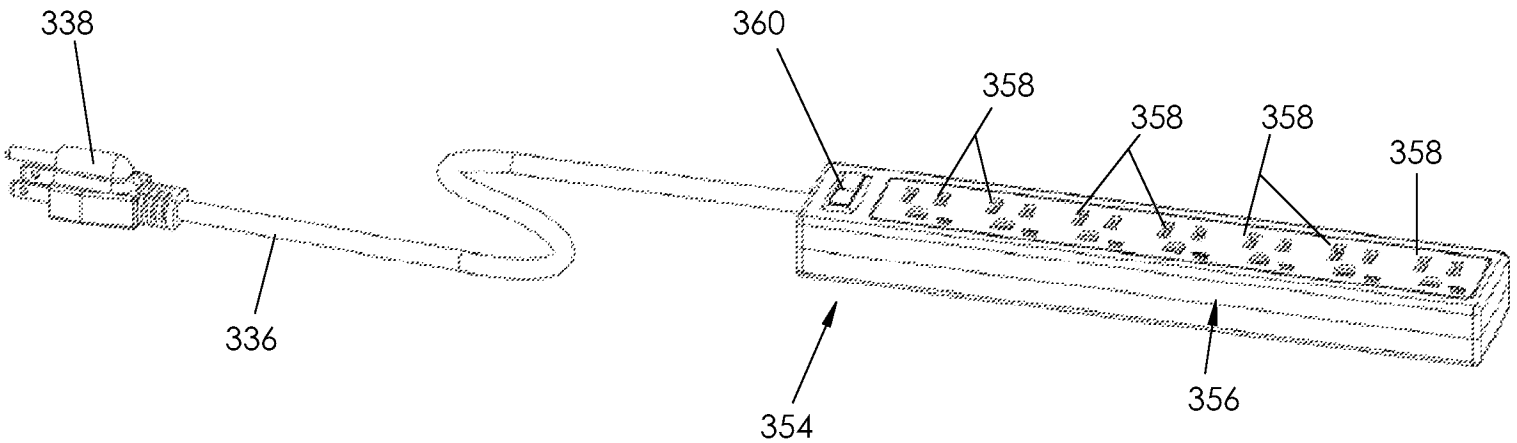
FIG. 51 is a perspective view of a power strip having a plurality of tamper resistant shutter systems therein; and, FIG. 52 is an exploded view of a power strip having a plurality of tamper resistant shutter systems therein.
Figure 52:
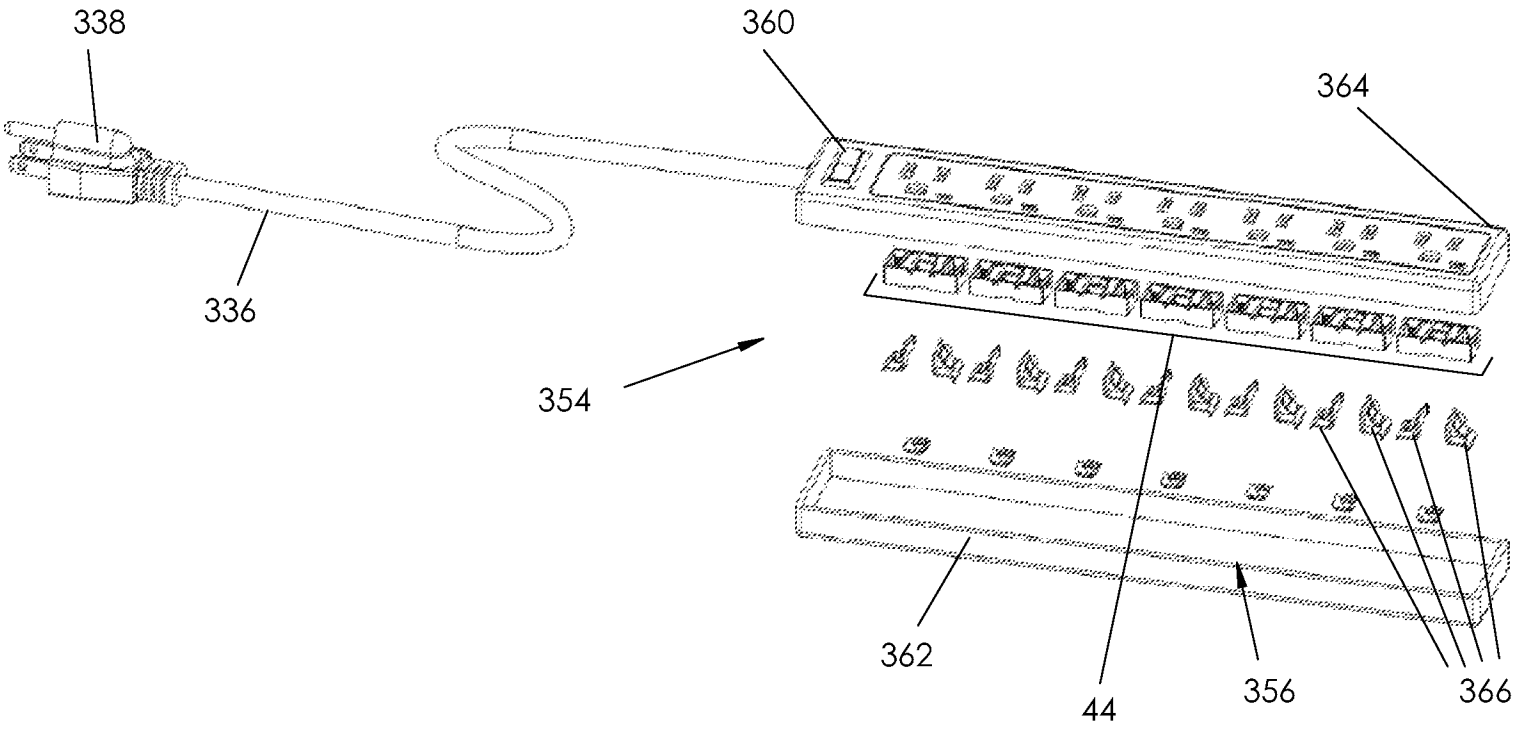

FIGS. 51 and 52 illustrate a power strip style device 354 having a first end 336 with a plug 338 and a second end 356. Second end 356 includes a plurality of electrical receptacle slots 358 for receiving electrical plugs. Further, second end 356 includes a power control switch 360 which can limit the electrical flow to electrical receptacle slots 358. Second end 356 includes a base 362, a top plate 364, and a plurality of electrical contacts 366. Electrical contacts 366 are secured between the base plate 362 and the top plate 364. Still further, a plurality of tamper resistant shutter members 44 are secured between the base 362 and the top plate 364, with a single tamper resistant shutter system limiting contact to each set of electrical contacts 366. Advantageously, each tamper resistant shutter system is independently operated to limit contact with the electrical contacts therein. This embodiment will work with any other tamper resistant shutter system discussed herein in relation to other embodiments.

In these and in any other aspects, the tamper resistant shutter assembly may be made of any materials and fabricated and/or assembled in any manner. For instance the tamper resistant shutter assembly may be manufactured from various different pieces and then screwed or glued together. In one embodiment for instance the shutter assemblies are molded of two pieces of plastic which are then ultrasonic welded together. The various elements, such as portions of the shutter members, may be manufactured as one piece or may be manufactured as separate pieces to be joined together.

It will be understood that implementations are not limited to the specific components disclosed herein, as virtually any components consistent with the intended operation of a method and/or system implementation for a tamper resistant shutter assembly may be utilized. Accordingly, for example, although particular bodies, arms, springs, and other components are disclosed, such components may comprise any shape, size, style, type, model, version, class, grade, measurement, concentration, material, weight, quantity, and/or the like consistent with the intended operation of a method and/or system implementation for a tamper resistant shutter assembly. Implementations are not limited to uses of any specific components, provided that the components selected are consistent with the intended operation of a method and/or system implementation for a tamper resistant shutter assembly.

Accordingly, the components defining any tamper resistant shutter assembly implementation may be formed of any of many different types of materials or combinations thereof that can readily be formed into shaped objects provided that the components selected are consistent with the intended operation of a tamper resistant shutter assembly implementation. For example, the components may be formed of rubbers (synthetic and/or natural) and/or other like materials; glasses (such as fiberglass), carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any tamper resistant electrical device implementation may be purchased premanufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld (e.g. an ultrasonic weld), a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The implementations listed here, and many others, will become readily apparent from this disclosure. From this, those of ordinary skill in the art will readily understand the versatility with which this disclosure may be applied.

The invention claimed is:

1. A tamper resistant assembly for an electrical device, comprising:

a first shutter member movable between open and closed positions;

a second shutter member movable between open and closed positions;

a third shutter member movable between open and closed positions, said third shutter member being movable from said closed position to said open position by movement of said second shutter member from said closed position to said open position; and a fourth shutter member movable between open and closed positions, said fourth shutter member being movable from said closed position to said open position by movement of said first shutter member from said closed position to said open position.

2. The tamper resistant assembly of claim 1, wherein a first biasing member biases said third shutter member to said closed position, and a second biasing member biases said fourth shutter member to said closed position.

3. The tamper resistant assembly of claim 1, wherein a first biasing member biases said first shutter member to said closed position, and a second biasing member biases said second shutter member to said closed position.

4. The tamper resistant assembly of claim 1, wherein a fifth shutter member is disposed adjacent said face of said electrical device and is movable between open and closed positions, and one of said third and fourth shutter members prevents movement of said fifth shutter member when said third or fourth shutter member is in said closed position.

5. The tamper resistant assembly of claim 1, wherein said first shutter member is disposed between a face of said electrical device and said third shutter member, and said second shutter member is disposed between said face of said electrical device and said fourth shutter member.

6. The tamper resistant assembly of claim 5, wherein a housing has first and second openings, said third shutter member preventing access to said first opening when in said closed position and said fourth shutter member preventing access to said second opening when in said closed position.

7. The tamper resistant assembly of claim 1, wherein said first and second shutter members pivot between said open and closed positions.

8. The tamper resistant assembly of claim 7, wherein said third and fourth shutter members pivot between said open and closed positions.

9. The tamper resistant assembly of claim 7, wherein said third shutter member slides linearly between said open and closed positions and said fourth shutter member pivots between said open and closed positions.

10. The tamper resistant assembly of claim 7, wherein said first and second shutter members pivot in the same direction.

11. The tamper resistant assembly of claim 7, wherein said first and second shutter members pivot in opposite directions.

12. The tamper resistant assembly of claim 7, wherein said third and fourth shutter members slide linearly between said open and closed positions.

13. The tamper resistant assembly of claim 12, wherein said linear movement is substantially horizontal.

14. The tamper resistant assembly of claim 12, wherein said linear movement is substantially vertical.

15. A tamper resistant assembly for an electrical device, comprising:

a first shutter member pivotally movable between open and closed positions;

a second shutter member pivotally movable between open and closed positions;

a third shutter member linearly movable between open and closed positions, said third shutter member being linearly movable from said closed position to said open position by pivotal movement of said second shutter member from said closed position to said open position;

a first biasing member biasing said third shutter member to said closed position;

a fourth shutter member linearly movable between open and closed positions, said fourth shutter member being linearly movable from said closed position to said open position by pivotal movement of said first shutter member from said closed position to said open position; and a second biasing member biasing said fourth shutter member to said closed position.

16. The tamper resistant assembly of claim 15, wherein said first shutter member is disposed between a face of said electrical device and said third shutter member, and said second shutter member is disposed between said face of said electrical device and said fourth shutter member.

17. The tamper resistant assembly of claim 15, wherein said linear movement is substantially horizontal.

18. The tamper resistant assembly of claim 15, wherein said linear movement is substantially vertical.

19. A tamper resistant assembly for an electrical device, comprising:

a first shutter member pivotally movable between open and closed positions;

a second shutter member pivotally movable between open and closed positions;

a third shutter member pivotally movable between open and closed positions, said third shutter member being pivotally movable from said closed position to said open position by pivotal movement of said second shutter member from said closed position to said open position; and a fourth shutter member pivotally movable between open and closed positions, said fourth shutter member being pivotally movable from said closed position to said open position by pivotal movement of said first shutter member from said closed position to said open position.

20. The tamper resistant assembly of claim 19, wherein said first shutter member is disposed between a face of said electrical device and said third shutter member, and said second shutter member is disposed between said face of said electrical device and said fourth shutter member.

21. The tamper resistant assembly of claim 19, wherein a first biasing member biases said first shutter member to said closed position; and a second biasing member biases said second shutter member to said closed position.

22. The tamper resistant assembly of claim 19, wherein a first gear connected to said first shutter member is engaged with a second gear connected to said fourth shutter member such that pivotal movement of said first shutter member results in pivotal movement of said fourth shutter member.

23. The tamper resistant assembly of claim 19, wherein a third gear connected to said second shutter member is engaged with a fourth gear connected to said third shutter member such that pivotal movement of said second shutter movement results in pivotal movement of said third shutter member.

* * * * *